US007841688B2

(12) United States Patent
Umeda

(10) Patent No.: US 7,841,688 B2
(45) Date of Patent: Nov. 30, 2010

(54) LIQUID EJECTING APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 174 days.

(21) Appl. No.: 12/193,154

(22) Filed: Aug. 18, 2008

(65) Prior Publication Data

US 2009/0051727 A1 Feb. 26, 2009

(30) Foreign Application Priority Data

Aug. 24, 2007 (JP) ..... 2007-218046

(51) Int. Cl.
*B41J 2/165* (2006.01)
*B41J 2/175* (2006.01)

(52) U.S. Cl. ..... 347/23; 347/29; 347/30; 347/36; 347/86

(58) Field of Classification Search ..... 347/23, 347/29, 30, 36, 86
See application file for complete search history.

(56) References Cited

U.S. PATENT DOCUMENTS 6,755,500 B2 * 6/2004 Hirano et al. ..... 347/22
6,846,072 B2 * 1/2005 Sato et al. ..... 347/86
2005/0212873 A1 9/2005 Usui et al.
2006/0137526 A1 6/2006 Ueda

FOREIGN PATENT DOCUMENTS

JP 2005271554 A 10/2005
JP 2005288770 A 10/2005
JP 2006206190 A 8/2006

* cited by examiner

*Primary Examiner*—Shih-wen Hsieh
(74) *Attorney, Agent, or Firm*—Baker Botts, LLP.

(57) ABSTRACT

A liquid ejecting apparatus including a liquid ejecting head, a liquid supply passage, a gas discharge passage, a gas-permeable film, a switching device, and a differential pressure valve. The gas-permeable film allows only gases to pass therethrough and provides a partition separating the gas discharge passage and the liquid supply passage. The switching device selectively connects a sucking device with one of the gas discharge passage and a liquid suction cap. The differential pressure valve is disposed in a portion of the gas discharge passage between the gas permeable film and the switching device and opens by a suction pressure from the sucking device to communicate the gas permeable film with the switching device when the sucking device is operating, and prevents communication between the gas permeable film and the switching device when the sucking device is not operating.

10 Claims, 18 Drawing Sheets

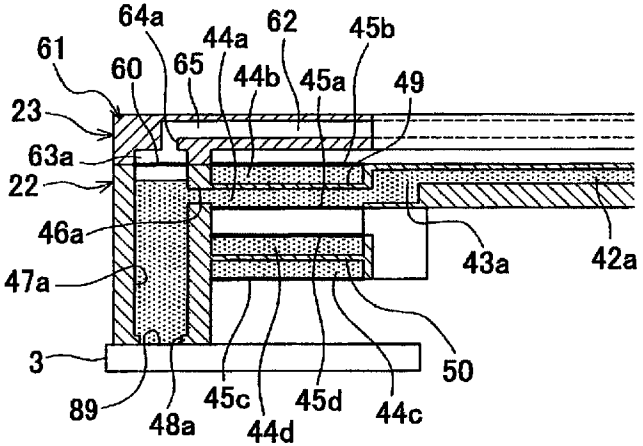
FIG.4A
FIG.4B
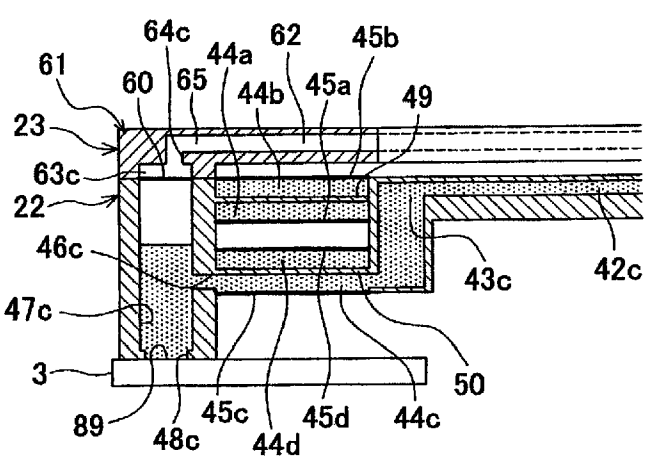
FIG.4C
FIG.4D

LIQUID EJECTING APPARATUS

CROSS REFERENCE TO RELATED APPLICATION

The present application claims priority from Japanese Patent Application No. 2007-218046 which was filed on Aug. 24, 2007, the disclosure of which is herein incorporated by reference in its entirety.

BACKGROUND OF THE INVENTION

1. Field of the Invention

The present invention relates to a liquid ejecting apparatus which ejects a droplet of a liquid from a nozzle.

2. Description of Related Art

An inkjet recording apparatus disclosed in JP-A-2005-288770 includes an inkjet recording head and a sub tank storing ink to be supplied to the recording head. The sub tank is vertically divided by a gas- or air-permeable film into two parts. The lower part, that is, the part located under the air-permeable film, constitutes an ink chamber for storing the ink, and the upper part, that is, the part located over the air-permeable film, constitutes a gas or air chamber to which a gas or air is discharged from the ink chamber. With the air chamber, a suction pump is connected through a valve opened and closed by a controller. To discharge the air from the air chamber and the ink chamber to the external, the suction pump is operated with the valve held opened so as to suck the air from the air chamber. After sucking the air from the air chamber by the suction pump, the valve is closed to hold the internal pressure of the air chamber at a lower level. A gas or air flowing into the ink chamber thereafter is sucked and discharged to the air chamber by the lowered pressure in the air chamber. Thus, it is prevented that when the ink is supplied to the recording head from the ink chamber, the gas or air flows into the recording head along with the ink. This inkjet recording apparatus further includes an ink suction cap that covers the recording head and sucks ink of which the viscosity has been increased, and others, from the inside of the recording head through nozzles formed in the recording head. a liquid In the above-described inkjet recording apparatus, the present applicant examined use of a single suction pump that is selectively connected to one of the air chamber and an ink suction cap so that the suction pump can function as a suction pump as well as a pump for the ink suction cap that operates to suck the ink from the nozzles.

Further, the applicant examined employment of a differential pressure valve that opens and closes without being controlled by a controller and in accordance with a pressure difference between a downstream space and an upstream space, so as to reduce the cost incurred by using a valve that requires a controller for its operation.

As a result of the examinations, applicant has found that when the above-described two techniques are employed, the ink sucked from the recording head adheres to a portion where connection of the suction pump is switched between the air chamber and the ink suction cap, and the adhering ink may separate therefrom and flow to the differential pressure valve disposed between the air chamber and the suction pump. When the ink reaches the differential pressure valve and adheres thereto and the viscosity of the ink increases there, the differential pressure valve become unable to normally operate.

SUMMARY OF THE INVENTION

This invention has been developed in view of the above-described situations, and it is an object of the invention, therefore, to provide a liquid ejecting apparatus which includes a sucking device that operates to suck a liquid from a liquid ejecting head that ejects a droplet of the liquid and to suck a gas or air in a gas discharge passage connected with a liquid supply passage through which the liquid is supplied to the liquid ejecting head, and a differential pressure valve that is disposed in the gas discharge passage and opens by a negative suction pressure produced by the sucking device, and which can prevent flow of the liquid sucked by the sucking device to the differential pressure valve.

To attain the above object, the invention provides a liquid ejecting apparatus including a liquid ejecting head having a nozzle from which a droplet of a liquid is ejected, a liquid supply passage which is connected with the liquid ejecting head and supplies the liquid to the liquid ejecting head, a gas discharge passage connected with the liquid supply passage so as to discharge a gas from the liquid supply passage, a gas-permeable film which allows gases to pass therethrough but not allows liquids to pass therethrough and which provides a partition separating the gas discharge passage and the liquid supply passage from each other in a connecting portion where the gas discharge passage and the liquid supply passage are connected with each other, a liquid suction cap for sucking the liquid in the liquid ejecting head through the nozzle, a sucking device which sucks liquids and gases, a switching device selectively connecting the sucking device with one of the gas discharge passage and the liquid suction cap, a differential pressure valve disposed in a portion of the gas discharge passage between the gas permeable film and the switching device, and being opened by a suction pressure from the sucking device to communicate the gas permeable film and the switching device with each other while the sucking device is operating, and disconnecting communication between the gas permeable film and the switching device while the sucking device is not operating, and a first liquid holding chamber which is disposed in a portion of the gas discharge passage between the differential pressure valve and the switching device, and in which the liquid flowing into the gas discharge passage from the switching device is trapped.

In the liquid ejecting apparatus where the first liquid holding chamber is disposed in the portion of the gas discharge passage between the differential pressure valve and the switching device, even when the liquid flows from the switching device to the differential pressure valve, the liquid is trapped in the first liquid holding chamber and does not tend to flow into the differential pressure valve. Hence, it is prevented that the liquid whose viscosity has increased inhibits the differential pressure valve from opening.

In a first preferable form of the liquid ejecting apparatus, a communication port of the first liquid holding chamber on the side of the differential pressure valve is disposed at a substantially same vertical level as an upper end of the first liquid holding chamber.

According to the first preferable form, the liquid in the first liquid holding chamber does not tend to flow out into the differential pressure valve.

In a second preferable form of the liquid ejecting apparatus, the differential pressure valve is disposed above the first liquid holding chamber.

According to the second preferable form, even when the liquid flows into the differential pressure valve beyond the first liquid holding chamber, the liquid does not tend to reach the differential pressure valve.

In a third preferable form of the liquid ejecting apparatus, a liquid retaining member is disposed in the first liquid holding chamber so as to hold the liquid having flown into the first liquid holding chamber.

According to the third preferable form, the liquid in the first liquid holding chamber does not tend to flow out into the differential pressure valve.

In a first preferable arrangement of the third preferable form, a first communication port of the first liquid holding chamber on the side of the differential pressure valve and a second communication port of the first liquid holding chamber on the side of the switching device are disposed above the liquid retaining member.

In the third preferable form where the liquid retaining member is disposed in an internal space of the first liquid holding chamber through or along which the gas passes, a gas-permeability of the liquid retaining member decreases with increase in an amount of the liquid held by the liquid retaining member, which decrease in the gas-permeability of the liquid retaining member may result in insufficiency in the sucking of the gas from the gas discharge passage during a gas discharge operation. According to the first preferable arrangement of the third preferable form, however, the communication ports of the first liquid holding chamber on the side of the differential pressure valve and on the side of the switching device are both disposed above the liquid retaining member. Hence, the communication ports of the first liquid holding chamber are communicated with other via a space in the liquid holding chamber over the liquid retaining member, thereby preventing that the liquid retaining member inhibits the gas flow through the liquid holding chamber. Further, since the liquid flowing into the first liquid holding chamber goes downward into the liquid retaining member by gravitation, the liquid does not flow out of the first liquid holding chamber into the differential pressure valve.

In a second preferable arrangement of the third preferable form, a gas passage is formed in the liquid retaining member to extend through the liquid retaining member, and the air passage allows the gas to pass across the liquid retaining member from a communication port of the first liquid holding chamber on the side of the differential pressure valve to a communication port of the first liquid holding chamber on the side of the switching device without the liquid permeating the liquid retaining member.

In the third preferable form where the liquid retaining member is disposed in an internal space of the first liquid holding chamber through or along which the gas passes, a gas-permeability of the liquid retaining member decreases with increase in an amount of the liquid held by the liquid retaining member, which decrease in the gas-permeability of the liquid retaining member may result in insufficiency in the sucking of the gas from the gas discharge passage during a gas discharge operation. According to the second preferable arrangement of the third preferable form, however, a gas passage is formed in the liquid retaining member, and thus even when the amount of the liquid held or retained by the liquid retaining member is relatively large, the gas can flow in and along the gas passage. Hence, it is prevented that the liquid retaining member inhibits the gas flow.

A fourth preferable form of the liquid ejecting apparatus further includes a second liquid holding chamber which is disposed in a portion of the gas discharge passage between the differential pressure valve and the gas permeable film, and in which the liquid is trapped when the liquid flows from the liquid supply passage through the gas permeable film into the gas discharge passage.

The gas-permeable film is disposed in the connecting portion where the gas discharge passage and the liquid supply passage are connected with each other. Normally, the gas-permeable film does not allow the liquid to pass therethrough and thus the liquid does not flow into the gas discharge passage from the liquid supply passage. However, after a long-term use, the gas-permeable film may be clogged with the liquid, and ultimately allow the liquid to pass therethrough or flow from the liquid supply passage into the gas discharge passage. In this case, too, when the liquid flows to and adheres to the differential pressure valve and the viscosity of the liquid increases there, the differential pressure valve may become inoperative or unable to open. However, according to the second preferable arrangement of the third preferable form where the second liquid holding chamber is disposed in the portion of the gas discharge passage between the differential pressure valve and the gas-permeable film, even when the liquid flows out of the liquid supply passage toward the differential pressure valve, the liquid is trapped in the second liquid holding chamber and does not tend to flow into the differential pressure valve. Hence, it is prevented that the liquid with increased viscosity disables the differential pressure valve to open.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIGS. 4A-4D are cross-sectional views respectively taken along lines 4A-4A, 4B-4B 4C-4C, and 4D-4D in FIG. 3;

DETAILED DESCRIPTION OF PREFERRED EMBODIMENTS

Hereinafter, there will be described presently preferred embodiments of the invention, by referring to the accompanying drawings.

Figure 1:
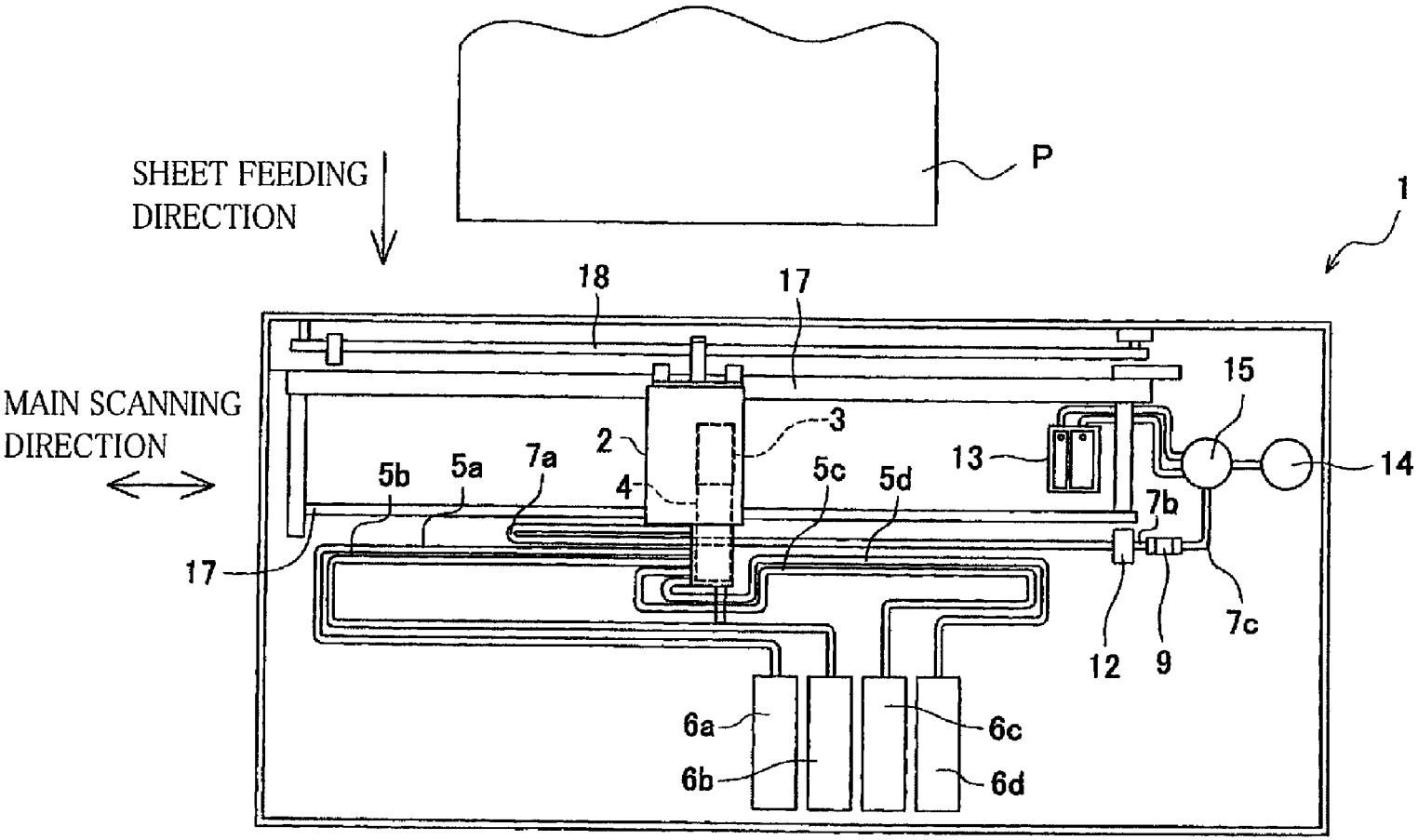
FIG. 1 is a schematic view of a printer as one embodiment of the invention.

Referring first to FIGS. 1-10B, there will be described one embodiment of the invention. FIG. 1 is a schematic view of a printer as one embodiment of the invention. As shown in FIG. 1, the printer 1 includes a carriage 2, an inkjet head 3, a sub tank 4, ink tubes 5*a*-5*d*, the ink cartridges 6*a*-6*d*, air tubes 7*a*-7*c*, a differential pressure valve device 9 (which may be simply referred to as "the valve device 9"), a charge tank 12, an ink suction cap 13, a sucking device in the form of a suction pump 14, and a switching device 15.

The carriage 2 is driven by a driving device 18 and reciprocated along a main scanning direction along two guide shafts 17 extending parallel to each other in a lateral direction as seen in FIG. 1 that corresponds to the main scanning direction. The inkjet head 3 is mounted on the carriage 2, and nozzles 95 are formed in an under surface of the inkjet head 3. Printing or recording on a recording sheet P is performed as follows. While reciprocated with the carriage 2 in the main scanning direction, the inkjet head 3 ejects from its nozzles 95 (shown in FIG. 5) ink as a liquid onto the recording sheet P being fed by a sheet feeding mechanism (not shown) in a sheet feeding direction that is downward as seen in FIG. 1.

The sub tank 4 is mounted on the carriage 2, and temporarily stores ink to be supplied to the inkjet head 3. One of two opposite ends of each of the ink tubes 5*a*-5*d* is connected with the sub tank 4, and the other end thereof is connected with one of the ink cartridges 6*a*-6*d*. The ink cartridges 6*a*-6*d* respectively store black, yellow, cyan, and magenta inks, which are supplied to the sub tank 4 through the respective ink tubes 5*a*-5*b*. The inkjet head 3 are thus supplied with the four color inks from the sub tank 4, and droplets of the four color inks are ejected from the nozzles 95.

The air tubes 7*a*-7*c* respectively connect the sub tank 4 with the charge tank 12; connect the charge tank 12 with the valve device 9, and connect the valve device 9 with the switching device 15. Thus, the sub tank 4 and the switching device 15 are connected with each other via the air tubes 7*a*-7*c*, the charge tank 12, and the valve device 9. It is noted that a gas passage or air passage extending from an air discharge device 23 (shown in FIG. 2 and described later) of the sub tank 4 to the switching device 15 through the air tubes 7*a*-7*c*, the charge tank 12, and the valve device 9 corresponds to an gas discharge passage.

As fully described later, the valve device 9 connects and disconnects the air tube 7*b* to and from the tube 7*c*. The charge tank 12 functions to prolong a period of time during which negative pressure is maintained in a portion of the gas discharge passage between the sub tank 4 and the valve device 9 after the internal pressure of the portion is made negative, as described later.

The ink suction cap 13 id disposed to be opposed to the under surface of the inkjet head 3 when the carriage 2 is located at the rightmost position as seen in FIG. 1 within its movable range. When the inkjet head 3 is moved to the position to be opposed to the ink suction cap 13, the ink suction cap 13 moves in a direction perpendicular to the plane of the sheet on which FIG. 1 is presented and toward the viewer, so as to cover the nozzles 95 open in the under surface of the inkjet head 3. The ink suction cap 13 is connected with the switching device 15.

The suction pump 14 is connected with the switching device 15. The switching device 15 selectively connects the suction pump 14 with either of the tube 7*c* and the ink suction cap 13. When operated while connected with the tube 7*c* via the switching device 15, the suction pump 14 can suck the gas or air in the gas discharge passage from the tube 7*c*, that is, the suction pump 14 can perform an air discharge operation. On the other hand, when operated while connected with the ink suction cap 13 via the switching device 15, the suction pump 14 can suck from the nozzles 95 the ink(s) in the inkjet head 3 whose viscosity has been increased, that is, the suction pump 14 can perform a liquid sucking operation.

Figure 2:
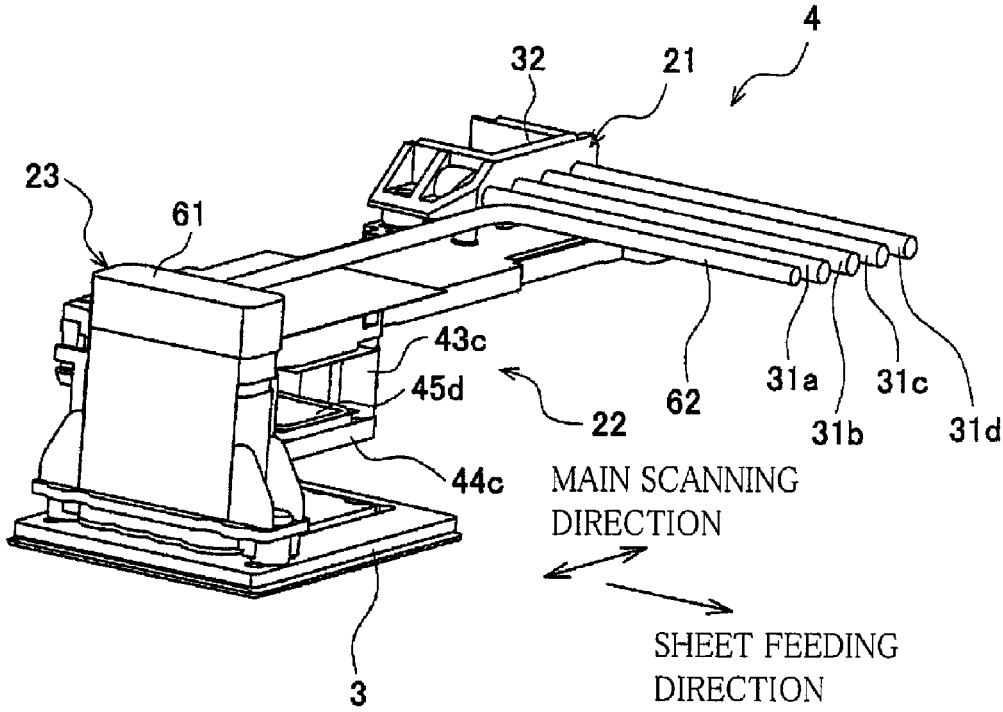
FIG. 2 is a schematic perspective view of a sub tank shown in FIG. 1.
Figure 3:
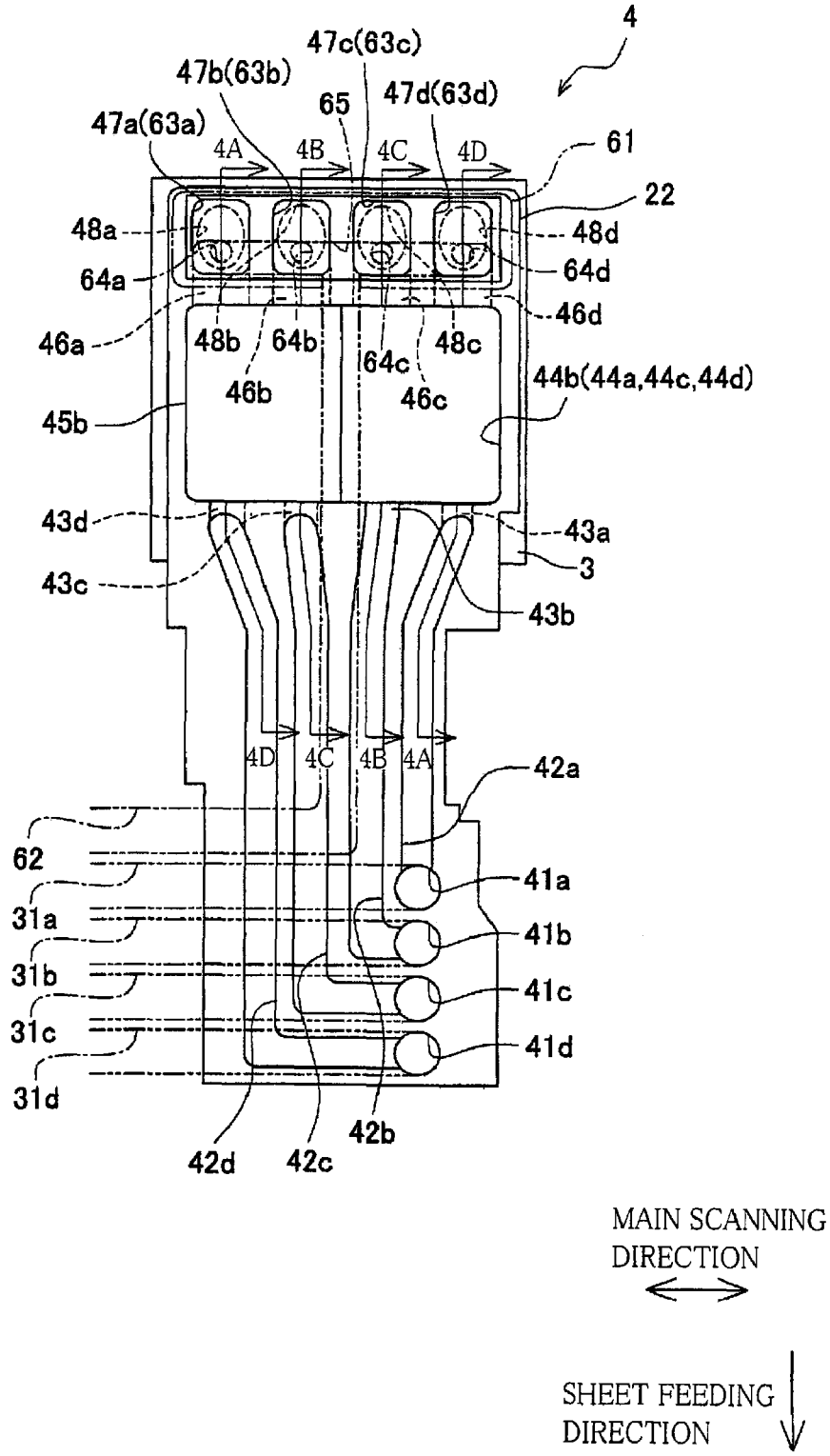
FIG. 3 is a plan view of the sub tank shown in FIG. 2.

Referring now to FIGS. 2-4D, there will be described in detail the sub tank 4. FIG. 2 is a general perspective view of the sub tank 4 shown in FIG. 1. FIG. 3 is a plan view of the sub tank 4 shown in FIG. 2. FIGS. 4A-4D are cross-sectional views taken along lines 4A-4A, 4B-4B, 4C-4C and 4D-4D in FIG. 3, respectively. For facilitating comprehension, in FIG. 3, inlet tubes 31*a*-31*d* of a connecting unit 21 (described later) and an air discharge device 23 (described later) are indicated by chain double-dashed line, and a connecting portion 32 of a connecting unit 21 (described later) and a part of a mainbody 22 of the sub tank 4 are not shown. As shown in FIGS. 2-4D, the sub tank 4 includes the connecting unit 21, the mainbody 22 of the sub tank 4, and the air discharge device 23.

The connecting unit 21 connects the ink tubes 5*a*-5*d* with the sub tank 4, and has the inlet tubes 31*a*-31*d* and the connecting portion 32. The inlet tubes 31*a*-31*d* are cylindrical tubes extending parallel to each other along the sheet feeding direction, and arranged in the main scanning direction at regular intervals. The inlet tubes 31*a*-31*d* are connected with the ink tubes 5*a*-5*d*, respectively, at their ends at the right side as seen in FIG. 2 (although in FIGS. 2 and 3 the ink tubes 5*a*-5*d* are not shown), and connected with the connecting portion 32 at their ends at the left side as seen in FIG. 2. The connecting portion 32 is bonded to an upper surface of an end portion of the mainbody 22 of the sub tank 4 with respect to the main scanning direction, and communicates the inlet tubes 31*a*-31*d* with connection openings 41*a*-41*d* (described later) of the mainbody 22 of the sub tank 4.

The mainbody 22 of the sub tank 4 has the connection openings 41*a*-41*d*, 42*a*-42*d*, 43*a*-43*d*, 46*a*-46*d*, 47*a*-47*d*, ink storage chambers 44*a*-44*d*, and the damper films 45*a*-45*d*. The connection openings 41*a*-41*d*, each circular in plan view, are arranged vertically at a lower right portion of the mainbody 22 of the sub tank 4, as seen in FIG. 3. To the mainbody 22 of the sub tank 4, the inks are supplied through the connection openings 41*a*-41*d*.

As seen in FIG. 3, the ink passage 42*a* extends from the connection opening 41*a* upward and then turns obliquely rightward, to a position under and adjacent to the ink storage chamber 44*a*.

As seen in FIG. 3, the ink passage 42*b* extends from the connection opening 41*b* leftward and then turns upward and thereafter rightward, to a position under and adjacent to the ink storage chamber 44*b*.

As seen in FIG. 3, the ink passage 42*c* extends from the connection opening 41*c* leftward and then turns upward and thereafter leftward, to a position under and adjacent to the ink storage chamber 44*c*.

As seen in FIG. 3, the ink passage 42*d* extends from the connection opening 41*d* leftward and then turns upward and thereafter leftward, to a position under and adjacent to the ink storage chamber 44*d*.

As seen in FIG. 3, the vertically extending portions of the ink passages 42*a*-42*d* are arranged from right to left in the alphabetical order.

The ink storage chambers 44*a*-44*d* are disposed at the positions adjacent to and over upper ends of the ink passages 42*a*-42*d* as seen in FIG. 3, such that the ink storage chambers 44*a*-44*d* overlap with one another in plan view. As shown in FIG. 4, the ink storage chambers are vertically arranged in the following order from top down: 44*b*, 44*a*, 44*d*, 44*c*. In plan view, each of the ink storage chambers 44*a*-44*d* has a rectangular shape long in the left-right direction of FIG. 3.

On an upper surface of the ink storage chamber 44*b* and an under surface of the ink storage chamber 44*a*, the damper films 45*b*, 45*a* are respectively disposed. That is, the damper films 45*b*, 45*a* respectively define the upper surface of the ink storage chamber 44*b* and the under surface of the ink storage chamber 44*a*. Between the ink storage chambers 44*b* and 44*a*, a separating wall 49 is disposed. That is, the separating wall 49 separates the ink storage chambers 44*b* and 44*a* from each other.

On an upper surface of the ink storage chamber 44*d* and an under surface of the ink storage chamber 44*c*, the damper films 45*d*, 45*c* are respectively disposed. That is, the damper films 45*d*, 45*c* respectively define the upper surface of the ink storage chamber 44*d* and the under surface of the ink storage chamber 44*c*. Between the ink storage chambers 44*d* and 44*c*, a separating wall 50 is disposed. That is, the separating wall 50 separates the ink storage chambers 44*d* and 44*c* from each other. Between the ink storage chambers 44*a* and 44*d*, a space is defined.

When the sub tank 4 is reciprocated with the carriage 2 in the main scanning direction while recording is performed or in other situations, the inks in the sub tank 4 move or oscillate to change the ink pressures in the sub tank 4, but the damper films 45*a*-45*d* deform and function to restrict such a pressure change.

The ink passage 43*a* extends from the upper end of the ink passage 42*a* as seen in FIG. 3, vertically downward (i.e., downward as seen in FIG. 4A) to the same level as the ink storage chamber 44*a*, and then turns leftward as seen in FIG. 4A to be connected with the ink storage chamber 44*a*.

The ink passage 43*b* extends from the upper end of the ink passage 42*b* as seen in FIG. 3 in the same direction as the ink passage 42*b*, i.e., leftward as seen in FIG. 4B, and connected with the ink storage chamber 44*b*.

The ink passage 43*c* extends from the upper end of the ink passage 42*c* as seen in FIG. 3, vertically downward (i.e., downward as seen in FIG. 4C) to the same level as the ink storage chamber 44*c*, and then turns leftward as seen in FIG. 4C to be connected with the ink storage chamber 44*c*.

The ink passage 43*d* extends from the upper end of the ink passage 42*d* as seen in FIG. 3, vertically downward (i.e., downward as seen in FIG. 4D) to the same level as the ink storage chamber 44*d*, and then turns leftward as seen in FIG. 4D to be connected with the ink storage chamber 44*d*.

As seen in FIGS. 4A-4D, the ink passages 46*a*-46*d* respectively extend leftward from left ends of the ink storage chambers 44*a*-44*d* to be connected with the ink passages 47*a*-47*d* that extend vertically and are arranged in the alphabetical order from left to right as seen in FIG. 3.

At their lower ends, the ink passages 47*a*-47*d* open. That is, the lower ends provides ink supply portions 48*a*-48*d* that are respectively connected with ink supply ports 89 (shown in FIG. 5) formed on the upper surface of the inkjet head 3. The inks in the ink passages 47*a*-47*d* are supplied to the inkjet head 3 through the ink supply portions 48*a*-48*d*.

At their upper ends, the ink passages 47*a*-47*d* open. In an upper surface of the mainbody 22 of the sub tank 4 at a position overlapping the ink passages 47*a*-47*d* in plan view, an air-permeable film 60 is disposed across the open ends of the ink passages 47*a*-47*d* to cover the open ends. The air-permeable film 60 allows transmission of gas only, and thus the inks in the ink passages 47*a*-47*d* cannot pass through the air-permeable film 60. Thus, when the suction pump 14 sucks the air from the gas discharge passage, or when the internal pressure of the gas discharge passage is held negative or lower than the atmospheric pressure as described later, only the air is sucked from the ink passages 47*a*-47*d* by the negative internal pressure of the gas discharge passage to be discharged to the gas discharge passage.

In the printer 1, the inks in the ink cartridges 6*a*-6*d* flow into the inlet tubes 31*a*-31*d* through the ink tubes 5*a*-5*d*, and then into the ink storage chambers 44*a*-44*d* via the connection openings 41*a*-41*d* and the ink passages 42*a*-42*b*, 43*a*-43*d*. Further, the inks temporarily stored in the ink storage chambers 44*a*-44*d* flow into the ink passages 47*a*-47*d*, and are supplied to the inkjet head 3 through the ink supply portions 48*a*-48*d*.

The ink passage extending from each of the ink cartridges 6*a*-6*d* to the inkjet head 3 via the corresponding ink tube 5*a*-5*d*, inlet tube 31*a*-31*d*, connection opening 41*a*-41*d*, ink passages 42*a*-42*d*, 43*a*-43*d*, the ink storage chamber 44*a*-44*d*, and ink passage 47*a*-47*d* corresponds to a liquid supply passage.

The discharge device 23 operates to discharge the air contained in the mainbody 22 of the sub tank 4 to the external, and has a connecting portion 61 and a discharge tube 62. The connecting portion 61 is disposed on the upper surface of the mainbody 22 of the sub tank 4 at a position to overlap the ink passages 47*a*-47*d* in plan view. The connecting portion 61 extends across the ink passages 47*a*-47*d* to cover the ink passages 47*a*-47*d*. In the connecting portion 61, individual air chambers 63*a*-63*d*, communication passages 64*a*-64*d*, and a common air chamber 65 are formed.

The individual air chambers 63*a*-63*d* are disposed at respective positions to overlap the ink passages 47*a*-47*d* in plan view. The ink passages 47*a*-47*d* are in communication with the individual air chambers 63*a*-63*d*, respectively, via the air-permeable film 60. That is, the air-permeable film 60 provides a partition wall separating the ink passages 47*a*-47*d* and the individual air chambers 63*a*-63*d* from each other at the connecting portion 61 of the air discharge device 23 where the ink passages 47*a*-47*d* and the individual air chambers 63*a*-63*d* are connected with each other. The common air chamber 65 is disposed over the individual air chambers 63*a*-63*d* such that as seen in FIG. 3 the common air chamber has a vertical dimension corresponding to about a lower half of the individual air chambers 63*a*-63*d*. The communication passages 64*a*-64*d* are disposed between the individual air chambers 63*a*-63*d* and the common air chamber 65, respectively, and vertically extend to enable communication therebetween.

The discharge tube 62 is a cylindrical tube whose one end is connected with a substantially central portion of a lower side (as seen in FIG. 3) of the common air chamber 65. As seen in FIG. 3, the discharge tube 62 extends downward from the common air chamber 65 and then turns leftward to form a horizontally extending portion. The horizontally extending portion of the discharge tube 62 and the inlet tubes 31*a*-31*d* are arranged in the main scanning direction at regular intervals. An end of the horizontally extending portion of the discharge tube 62 is connected with the air tube 7*a*, although in (FIGS. 2 and 3 the air tube 7*a* is not shown.

Figure 5:
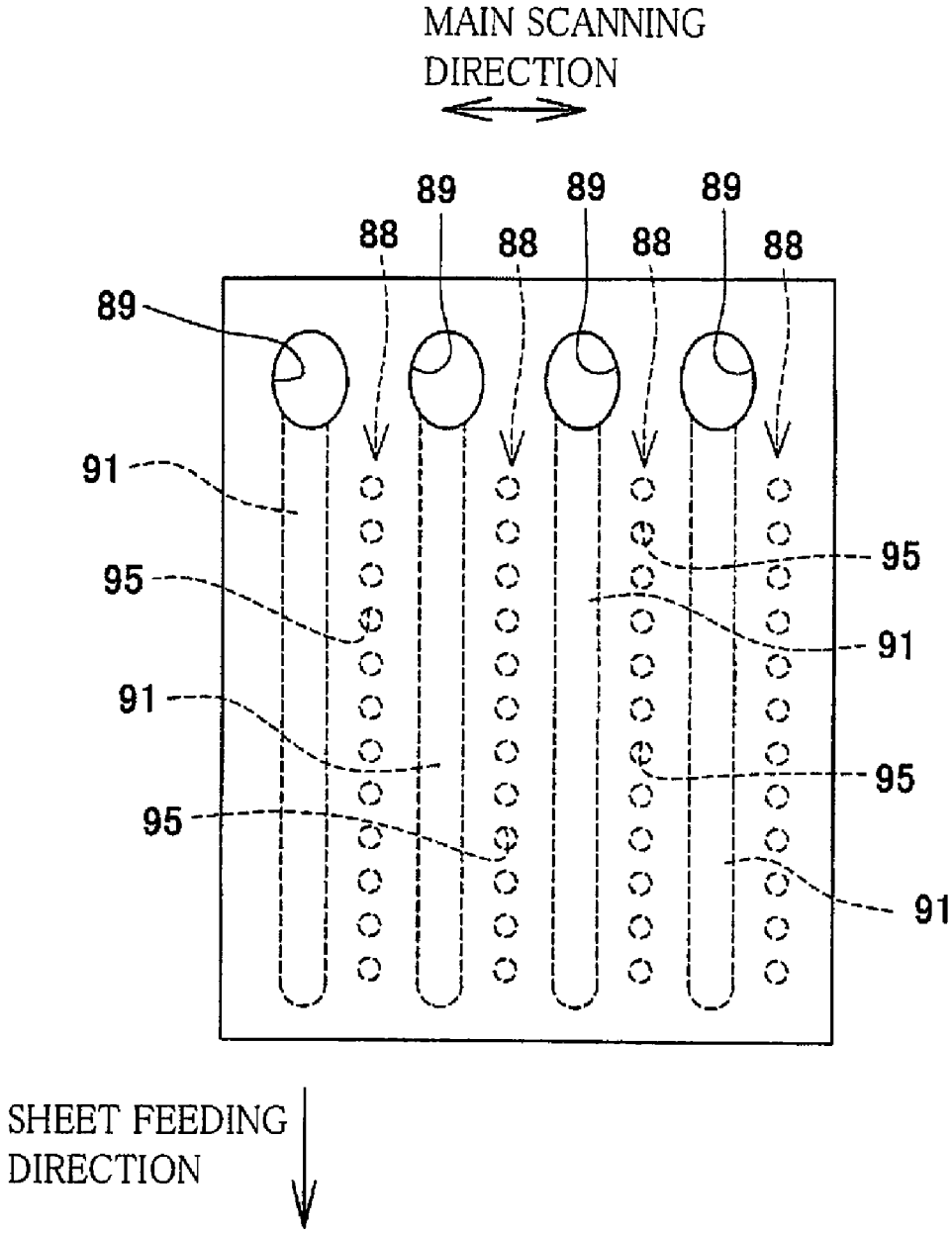
FIG. 5 is a plan view of an inkjet head shown in FIG. 1.
Figure 6:
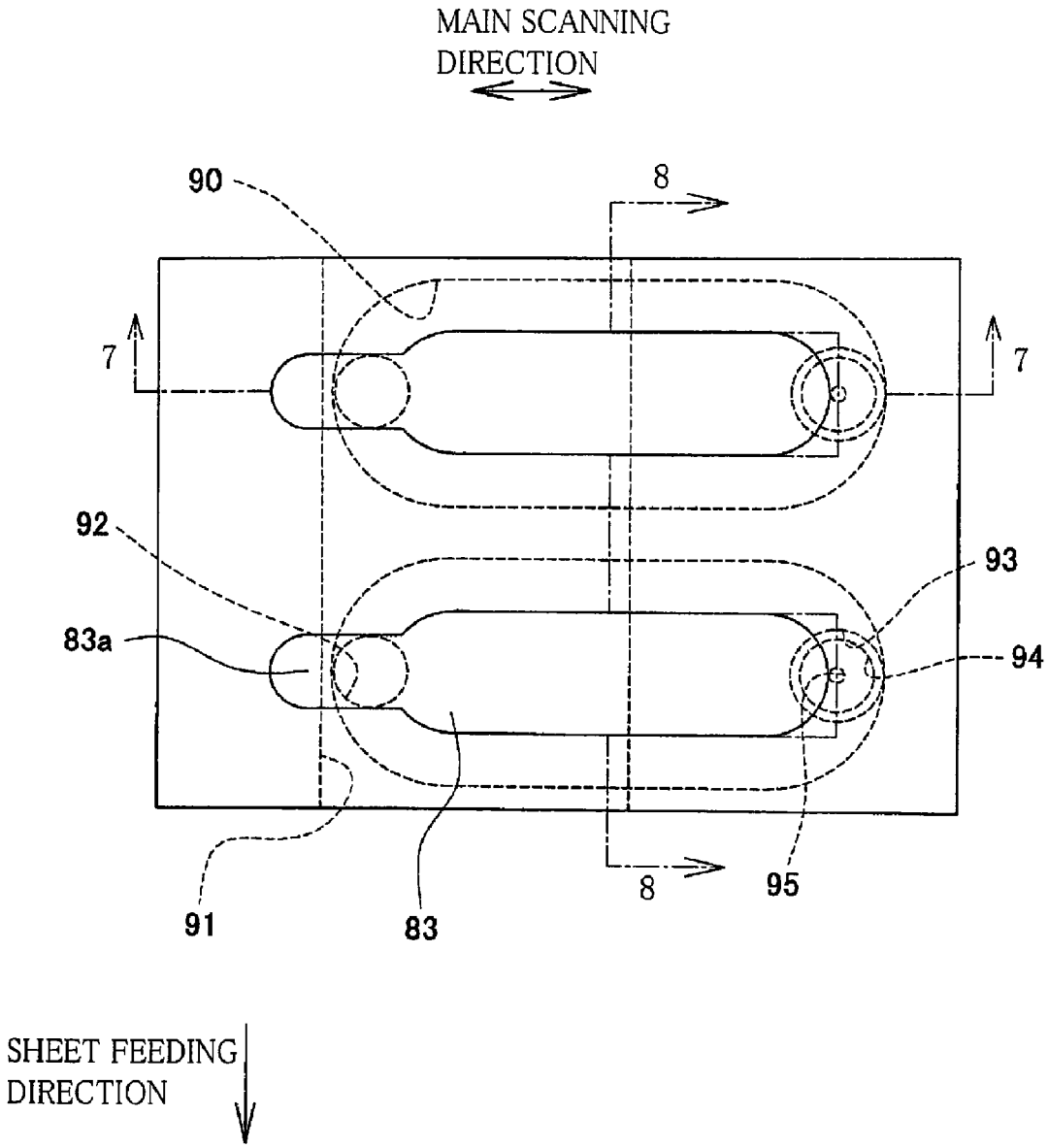
FIG. 6 shows a part of FIG. 5 in enlargement.
Figure 7:
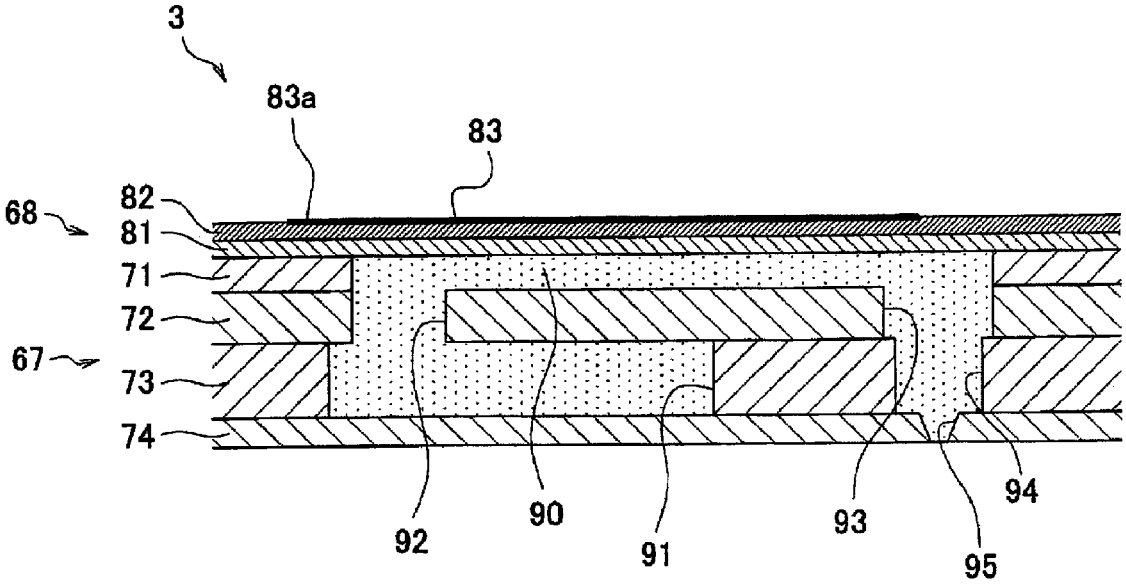
FIG. 7 is a cross-sectional view taken along line 7-7 in FIG. 6.
Figure 8:
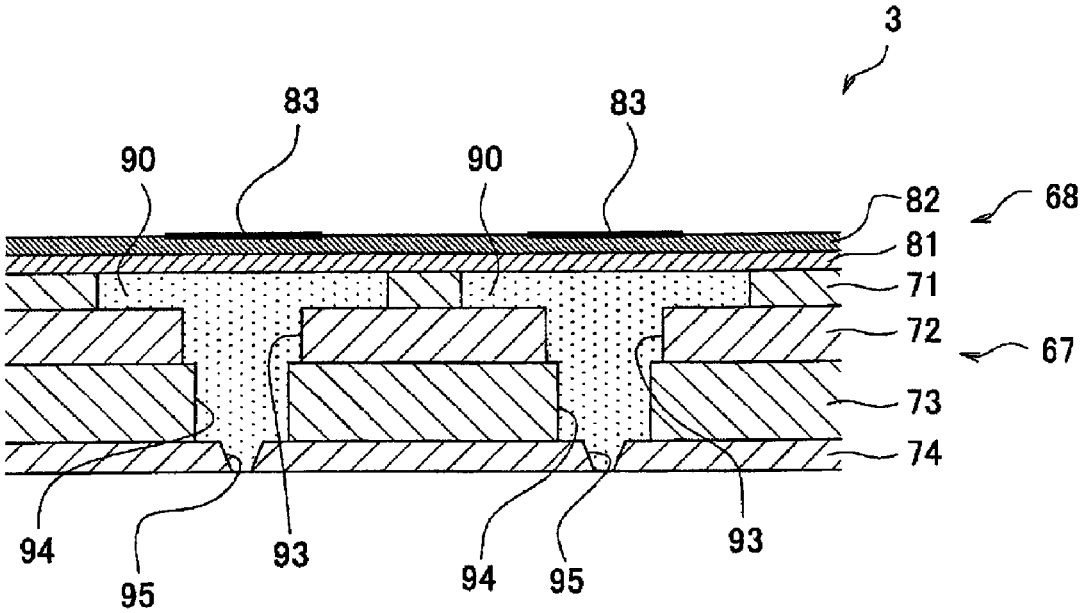
FIG. 8 is a cross-sectional view taken along line 8-8 in FIG. 6.

Referring to FIGS. 5-8, there will be described the inkjet head 3. FIG. 5 is a plan view of the inkjet head 3 shown in FIG. 1. FIG. 6 shows a part of FIG. 5 in enlargement. FIGS. 7 and 8 are cross-sectional views respectively taken along lines 7-7 and 8-8 in FIG. 6. In FIG. 5, pressure chambers 90 (described later) and through-holes 92-94 are not shown, and the nozzles 95 are depicted as being large as compared to those in FIGS. 6-8, for facilitating comprehension.

As shown in FIGS. 5-8, the inkjet head 3 includes a passage unit 67 in which ink passages each including a pressure chamber 90 are formed, and a piezoelectric actuator 68 disposed on an upper surface of the passage unit 67.

The passage unit 67 are a laminate of four plates, namely, a cavity plate 71, a base plate 72, a manifold plate 73, and a nozzle plate 74 that are stacked in the order of description from top down. Among the four plates 71-74, three plates 71-73 are formed of a metallic material such as stainless steel, and the nozzle plate 74 is formed of a synthetic resin material such as polyimide. Alternatively, the nozzle plate 74 may be formed of a metallic material like the other plates 71-73.

In the nozzle plate 74, a plurality of nozzles 95 are formed. The nozzles 95 are arranged in four rows 88 which are arranged in the main scanning direction (i.e., the left-right direction as seen in FIG. 5) and each of which extends in the sheet feeding direction (i.e., the vertical direction as seen in FIG. 5). From the nozzles 95 of the respective rows 88, droplets of the black, yellow, cyan and magenta inks are ejected from left to right as seen in FIG. 5.

In the cavity plate 71, a plurality of pressure chambers are formed to respectively correspond to the nozzles 95. In plan view, each of the pressure chambers 90 has an elliptic shape long in the main scanning direction, and the pressure chambers 90 are disposed such that right ends thereof overlap the nozzles 95 in plan view. In the base plate 72, the through-holes 92, 93 are formed at respective positions that overlap opposite longitudinal ends of the pressure chambers 90 in plan view.

In the manifold plate 73 are formed four manifold passages 91 corresponding to the four nozzle rows 88. The manifold passages 91 extend in the sheet feeding direction on the left side of the corresponding nozzle rows 88, respectively. Each of the manifold passages 91 overlaps a substantially left half of the pressure chambers 90 of the corresponding row in plan view. At an upper end portion of each of the manifold passages 91 as seen in FIG. 5, one of the ink supply ports 89 is disposed. The ink supply ports 89 are connected with the ink supply portions 48*a*-48*d* of the sub tank 4 as described above, and the inks in the sub tank 4 are supplied through the ink supply ports 89 to the manifold passages 91. In the manifold plate 73, a through-hole 94 is formed at a position to overlap the through-hole 93 and the nozzle 95 in plan view.

In the passage unit 67, the manifold passages 91 are communicated with the pressure chambers 90 via the through-holes 92, and the pressure chambers 90 are further communicated with the nozzles 95 via the through-holes 93, 94. In this way, in the passage unit 67 are formed a plurality of individual ink passages each extending from an outlet of one of the manifold passages 91 to one of the nozzles 95 via a corresponding one of the pressure chambers 90.

The piezoelectric actuator 68 includes a diaphragm 81, the piezoelectric layer 82, and a plurality of individual electrodes 83. The diaphragm 81 is formed of an electrically conductive material such as metal material, and bonded to an upper surface of the cavity plate 71 to cover the pressure chambers 90. The diaphragm 81, which has an electrical conductivity, also functions as a common electrode for applying voltage to a portion of the piezoelectric layer 82 disposed between the individual electrodes 83 and the diaphragm 81, as described later, and is connected with a driver IC (not shown) to be kept at the ground voltage.

The piezoelectric layer 82 is formed of a piezoelectric material containing mixed crystals of lead titanate and lead zirconate and has a ferroelectricity, that is, the primary component of the piezoelectric material is lead zirconate titanate. The piezoelectric layer 82 is disposed on an upper surface of the diaphragm 81 continuously across the pressure chambers 90. The piezoelectric layer 82 is polarized in a direction of its thickness.

The individual electrodes 83 are disposed on an upper surface of the piezoelectric layer 82 to positionally correspond to the pressure chambers 90. In plan view, each of the individual electrodes 83 has a substantially elliptic shape smaller than that of the pressure chamber 90, and disposed at a position to overlap a substantially central portion of the corresponding pressure chamber 90. A longitudinal end of the individual electrode 83, i.e., a left end thereof as seen in FIG. 6, is located on the left side of the pressure chamber 90 and does not overlap the pressure chamber 90 in plan view. This end provides a contact 83*a*, with which the driver IC (not shown) is connected through a wiring member (not shown) such as a flexible printed circuit board (FPC). By operation of the driver IC, a drive voltage is selectively applied to the individual electrodes 83.

There will be described how the piezoelectric actuator 68 is driven. In the piezoelectric actuator 68, the electrical potential of the individual electrodes 83 is kept at the ground voltage by the driver IC not shown. When the driver IC applies a drive voltage to one of the individual electrodes 83, a potential difference occurs between the individual electrode 83 to which the drive voltage is applied and the diaphragm 81 as a common electrode kept at the ground voltage. Thus, an electrical field occurs, in the direction of the thickness of the piezoelectric layer 82, at a portion of the piezoelectric layer 82 that is sandwiched between the individual electrode 83 and the diaphragm 81. Since the direction of the electrical field is parallel to the direction in which the piezoelectric layer 82 is polarized, the portion of the piezoelectric layer 82 contracts in a horizontal direction which is perpendicular to the polarization direction. Thus, a portion of the diaphragm 81 and the piezoelectric layer 82 that is opposed to the pressure chamber 90 corresponding to the individual electrode 83 to which the drive voltage is applied deform convexly toward the pressure chamber 90, which reduces an inner volume of the pressure chamber 90. Hence, the ink pressure in the pressure chamber 90 increases, whereby an ink droplet is ejected from the nozzle 95 communicated with the pressure chamber 90.

There will be described the valve device 9, by referring to FIG. 9 which is a cross-sectional view of the valve device 9 shown in FIG. 1.

Figure 9:
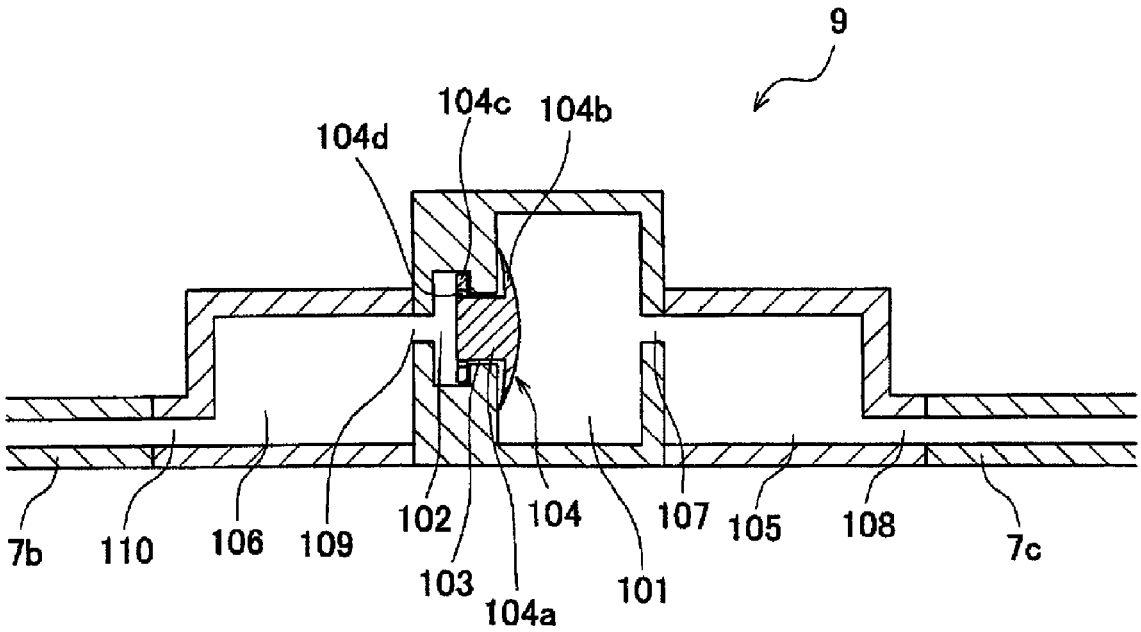
FIG. 9 a cross-sectional view showing a differential pressure valve shown in FIG. 1.

As shown in FIG. 9, the valve device 9 includes air chambers 101, 102, a communication passage 103, a valve element 104, and a first ink holding chamber 105 (first liquid holding chamber) and a second ink holding chamber 106 (second liquid holding chamber). The air chambers 101 and 102 are disposed side by side in a left-right direction as seen in FIG. 9. The communication passage 103 extends between the air chambers 101 and 102 in the left-right direction to enable communication therebetween. The communication passage 103 is generally circular as seen in the left-right direction in FIG. 9, and has a diameter smaller than dimensions of the air chambers 101, 102 in the vertical direction in FIG. 9 and in a direction perpendicular to the plane of the sheet in which FIG. 9 is presented.

The valve element 104 includes a columnar portion 104*a*, a cutoff portion 104*b*, and a retaining portion 104*c*. The columnar portion 104*a* has a substantially columnar shape whose diameter is slightly smaller than that of the communication passage 103, and extends from a left end of the air chamber 101 to a right end of the air chamber 102 as seen in FIG. 9 through the communication passage 103. The cutoff portion 104*b* is disposed adjacent to a right end of the columnar portion 104*a* as seen in FIG. 9, and extends outward from the columnar portion 104*a* in a beveled shape whose diameter is larger than that of the communication passage 103. The retaining portion 104*c* is disposed adjacent to a left end of the columnar portion 104*a* as seen in FIG. 9, and extends outward from the columnar portion 104*a*. A diameter of the retaining portion 104*c* is larger than that of the communication passage 103. In a portion of the retaining portion 104*c* which overlaps a peripheral portion of the communication passage 103 at one of two opposite sides of the communication passage 103 with respect to the left-right direction in FIG. 9, a plurality of through-holes 104*d* are formed. The air chambers 101 and 102, the communication passage 103, and the valve element 104 of the valve device 9 cooperate to constitute a differential pressure valve.

While the suction pump 14 is operating to suck the air from the gas discharge passage, the valve element 104 receives the suction pressure from the suction pump 14 and is displaced rightward as seen in FIG. 9. Thus, a clearance occurs between the cutoff portion 104*b* and a left wall of the air chamber 101 as seen FIG. 9, that is, the valve device opens. Consequently, the air chambers 101 and 102 are communicated with each other via the through-holes 104*d* and the communication passage 103. With the air chambers 101, 102 thus brought into communication with each other, the gas discharge passage and the switching device 15 are communicated with each other. Since at this time a right surface of the retaining portion 104*c* is brought into contact with a surface of a right wall defining the air chamber 102, the valve element 104 is prevented from falling out of the communication passage 103. When the suction pump 14 sucks the air from the gas discharge passage while the gas discharge passage is in communication with the switching device 15, the internal pressure of the gas discharge passage decreases to negative or to a level lower than the atmospheric pressure.

On the other hand, after the sucking of the air by the suction pump 14 from the gas discharge passage, the internal pressure of the air chamber 102 is negative and thus the valve element 104 is sucked by the negative pressure and displaced leftward as seen in FIG. 9 until a peripheral portion of the cutoff portion 104*b* is brought into pressing contact with the left wall of the air chamber 101 as seen in FIG. 9. Thus, the clearance between the cutoff portion 104*b* and the left wall of the air chamber 101 is eliminated, that is, the valve device 9 is closed, and the communication between the air chamber 101 and the communication passage 103 and the air chamber 102 is disconnected. At this time, a portion of the gas discharge passage between the valve device 9 and the air-permeable film 60 is disconnected from the external and airtight.

Thus, the internal pressure of the portion of the gas discharge passage between the valve device 9 and the air-permeable film 60 is held negative. Hence, even after sucking of the air from the gas discharge passage by the suction pump 14, the air in the ink passages 47*a*-47*d* is sucked by the negative pressure and discharged to the gas discharge passage.

As described above, according to the valve device 9 of the present embodiment, when the internal pressure of a portion of the gas discharge passage between the valve element 104 and the sub tank 4 is sufficiently smaller than the internal pressure of another portion of the gas discharge passage between the valve element 104 and the switching device 15 or the suction pump 14, in other words, when the former internal pressure is smaller than the latter internal pressure by more than a predetermined amount, communication between the two portions of the gas discharge passage is disconnected. On the other hand, when that is not the case, that is, when the former internal pressure is smaller than the latter internal pressure by an amount smaller than the predetermined amount, when the former and latter internal pressures are equal to each other, or when the latter internal pressure is smaller than the former internal pressure, communication between the two portions of the gas discharge passage is allowed. The differential pressure valve of the present embodiment is a check valve that allows flow of the air from the sub tank 4 to the switching device 15, and does not allow flow of the air from the switching device 15 to the sub tank 4.

The first ink holding chamber 105 is disposed adjacent to the air chamber 101 on the right side thereof. The first ink holding chamber 105 has communication ports 107, 108 on the opposite sides with respect to the direction of air flow, and is communicated with the air chamber 101 through the communication port 107, which is one of two ports on the side of the differential pressure valve. The communication port 107 is disposed at a substantially same vertical level as an upper end of the first ink holding chamber 105 is located. Through the other communication port 108 that is disposed at a right lower end portion of the first ink holding chamber 15 as seen in FIG. 9 (i.e., the communication port on the side of the switching device), the first ink holding chamber 105 is communicated with the tube 7*c*.

As described above, after the suction pump 14 has sucked the air from the gas discharge passage through the tube 7*c*, the internal pressure of the portion of the gas discharge passage between the valve device 9 and the air-permeable film 60 is held negative. However, over time, air flows into this portion of the gas discharge passage where the negative pressure is maintained, through a small clearance between the valve element 104 and the air chamber 101 or others. In other words, the negative pressure leaks to the external. Since the ink, more strictly, the four color inks, having been sucked from the inkjet head 3 and flown to the switching device 15 via the ink suction cap 13 are present on, or adhere to, the switching device 15, if such a negative pressure leak occurs, the adhering inks separate from the switching device 15 and flow with the air to the valve device 9.

As described above, the force applied to displace the valve element 104 of the valve device 9 rightward as seen in FIG. 9 so as to have the air chambers 101, 102 communicated with each other is the suction pressure from the suction pump 14, which is relatively small. Hence, if the inks adhering to the switching device 15 separate therefrom and flow into the air chambers 101, 102 and the communication passage 103 of the valve device 9, the inks adhere to the valve element 104. When the viscosity of the inks thus adhering to the valve element 104 increases, it becomes impossible to displace the valve element 104 or to place the valve element 104 in its opened position even when the suction pump 14 operates to suck the air from the gas discharge passage, making it impossible to have the air chambers 101 and 102 communicated with each other.

However, in this embodiment where the first ink holding chamber 105 is disposed on the right side of the air chamber 101 of the valve device 9 (that is, disposed in the portion of the gas discharge passage between the differential pressure valve and the switching device 15), the inks flowing into the valve device 9 from the switching device 15 is trapped in the first ink holding chamber 105. Thus, it is prevented that the inks flow into the air chambers 101, 102 and the communication passage 103 and adhere to the valve element 104. Further, since the communication port 107 through which the first ink holding chamber 105 and the air chamber 101 are communicated with each other is disposed at the substantially same vertically level as the upper end of the first ink holding chamber 105, as described above, the inks do not tend to flow into the air chamber 101 out of the first ink holding chamber 105.

The second ink holding chamber 106 is disposed adjacent to the air chamber 102 on the left side of the air chamber 102. The second ink holding chamber 106 has communication ports 109 and 110 at the opposite ends thereof with respect to the direction of air flow, and is communicated with the air chamber 102 through the communication port 109. The communication port 109 is disposed at a substantially same vertical level as an upper end of the second ink holding chamber 106. The communication port 110 is disposed at left lower end portion of the second ink holding chamber 106 as seen in FIG. 9, and the second ink holding chamber 106 is communicated with the tube 7*b* through the communication port 110.

As described above, in the sub tank 4, the ink passages 47*a*-47*d* and the individual air chambers 63*a*-63*d* are separated from each other by the air-permeable film 60, and normally the inks in the ink passages 47*a*-47*d* do not flow into the individual air chambers 63*a*-63*d* through the air-permeable film 60. However, as a result of a long-term use, the inks in the ink passages 47*a*-47*d* come to clog pores of the air-permeable film 60, and ultimately pass through the air-permeable film 60 and flow into the individual air chambers 63*a*-63*d*.

If the inks undesirably flow into the individual air chambers 63*a*-63*d* in this way, when the suction pump 14 thereafter operates to suck the air from the gas discharge passage, the inks having flown into the individual air chambers 63*a*-63*d* are also sucked with the air and flow from the individual air chambers 63*a*-63*d* to the valve device 9. If the inks then flow into the air chambers 102, 101 and the communication passage 103 of the valve device 9 and adhere to the valve element 104, when the suction pump 14 thereafter operates to suck the air from the tube 7*c*, it may be impossible to have the air chambers 101 and 102 communicated with each other, just like the case described above with respect to the first ink holding chamber 105.

However, in this embodiment where the second ink holding chamber 106 is disposed on the left side of the air chamber 102 of the valve device 9 (that is, disposed in the portion of the gas discharge passage between the differential pressure valve and the air-permeable film 60), the inks flowing into the valve device 9 from the individual air chambers 63*a*-63*d* are trapped in the second ink holding chamber 106. Thus, it is prevented that the inks flow into the air chambers 102, 101 and the communication passage 103. Further, since the communication port 109 through which the second ink holding chamber 106 and the air chamber 102 are communicated with each other is disposed at the substantially same vertically level as the upper end of the second ink holding chamber 106, as described above, the inks do not tend to flow into the air chamber 102 out of the second ink holding chamber 106.

Figure 10A:
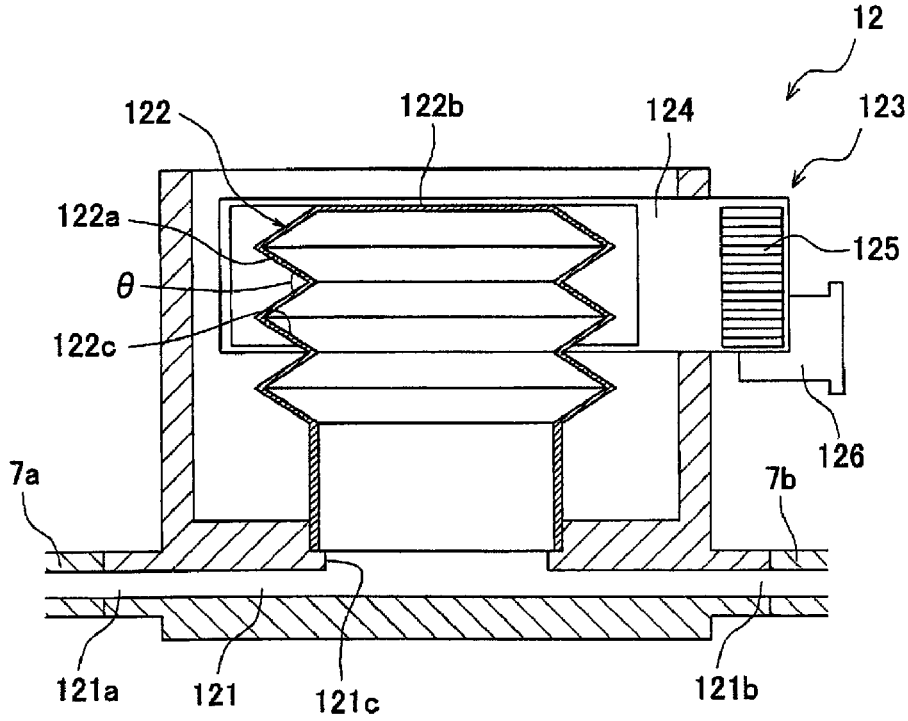
FIG. 10 is a cross-sectional view showing a charge tank shown in FIG. 1.
Figure 10B:
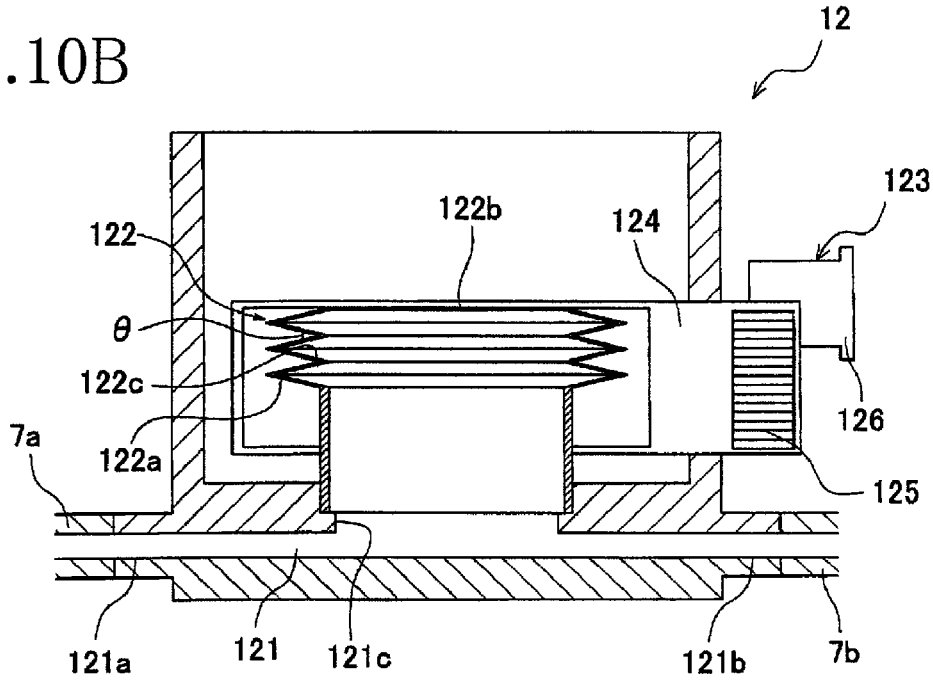

There will be described the charge tank 12, by referring to FIGS. 10A and 10B, which are cross-sectional view of the charge tank 12. FIG. 10A shows a case where the internal pressure of a charge chamber 122*c* (described later) is at the atmospheric pressure, and FIG. 10B shows a case where the internal pressure of the charge chamber 122*c* is negative. As shown in FIGS. 10A and 10B, the charge tank 12 includes an air passage 121, a bellows portion 122 and a pressure detector 123.

The air passage 121 extends in a left-right direction as seen in FIGS. 10A and 10B, and has communication openings 121*a* and 121*b* at left and right ends thereof. The communication openings 121*a*, 121*b* are communicated with the air tubes 7*a*, 7*b*, respectively. The air passage 121 further includes a communication opening 121*c* disposed at an upper side of a substantially central portion of the air passage 121 as seen in FIGS. 10A and 10B. At the communication opening 121*c*, the air passage 121 is communicated with the charge chamber 122*c* (described later) of the bellows portion 122.

The bellows portion 122 extends vertically as seen in FIGS. 10A and 10B, and has the charge chamber 122*c* defined inside thereof by a ceiling wall 122*b* and a side wall 122*a*. The ceiling wall 122*b* defines an upper end of the charge chamber 122*c*, and is substantially circular in plan view. The side wall 122*a* defines a side surface of the charge chamber 122*c*, and extends from an edge of the ceiling wall 122*a* such that the side wall 122*a* is folded vertically alternately outward and inward of the charge chamber 122*c*. When a vertical force is imposed on the ceiling wall 122*b*, the ceiling wall 122*b* is displaced in a vertical direction, as well as a fold angle θ of the side wall 122*a* changes. This results in a change in the inner volume of the charge chamber 284*c*. The charge chamber 122*c* is open at its lower end, where the charge chamber 122*c* is connected with the communication opening 121*c*. Thus, the air passage 121 and the charge chamber 122*c* (or the gas discharge passage) are communicated with each other.

While the internal pressure of the charge chamber 122*c* is atmospheric, the bellows portion 122, the ceiling wall 122*b* is at its highest position and the fold angle θ of the side wall 122*a* takes the largest value that the side wall 122*a* can take, as shown in FIG. 10A. When the air is sucked from the tube 7*c* by the suction pump 14 in this state, the internal pressure of the charge chamber 122*c* decreases and accordingly a downward force acts on the ceiling wall 122*b* due to a difference between the internal pressure of the charge chamber 122*c* and the external pressure of the charge chamber, i.e., the atmospheric pressure. Hence, the ceiling wall 122*b* is downward displaced and the fold angle θ of the side wall 122*a* decreases as shown in FIG. 10B. With such a deformation of the bellows portion 122, the inner volume of the charge chamber 122*c* decreases.

When the fold angle θ of the side wall 122*a* decreases from the level shown in FIG. 10A, a reaction force acting upward as seen in FIG. 10A occurs at the side wall 122*a* to restore the side wall 122*a* to the state shown in FIG. 10A. As the fold angle θ of the side wall 122*a* decreases from the level shown in FIG. 10A, the reaction force increases. The change in the inner volume of the charge chamber 122*c* in the bellows portion 122 stops when the force resulting from the difference between the internal and external pressures of the charge chamber 122*c* and the reaction force come to equilibrium. Thus, the inner volume of the charge chamber 122*c* decreases with the internal pressure of the charge chamber 122*c*. That is, the internal pressure of the charge chamber 122*c* and the inner volume of the charge chamber 122*c* are in a correlationship.

On the other hand, when the air in the ink passages 47*a*-47*d* is discharged to the individual air chambers 63*a*-63*d* through the air-permeable film 60 while the internal pressure of the charge chamber 122*c* is held negative as shown in FIG. 10B, the internal pressure of the charge chamber 122*c* that is in communication with the individual air chambers 63*a*-63*d* increases. This decreases the force resulting from the difference between the internal and external pressures of the charge chamber 122*c*, and accordingly the ceiling wall 122*b* of the bellows portion 122 is displaced upward with the fold angle θ of the side wall 122*a* increased. When the bellows portion 122 deforms in this way, the inner volume of the charge chamber 122*c* increases.

Since the charge chamber 122*c* is disposed in the gas discharge passage, the inner volume of the gas discharge passage is larger than that in the case where the charge tank 12 is not employed, by an amount corresponding to the inner volume of the charge chamber 122*c*. This is effective to reduce a rate of the increase in the internal pressure of the gas discharge passage at the time when the air flows into the gas discharge passage from the ink passages 47*a*-47*d* and thus prolong a time during which the internal pressure of the gas discharge passage can be held negative. It is noted that when the air flows out of the ink passages 47*a*-47*d* into the gas discharge passage and the inner volume of the charge chamber 122*c* increases, the inner volume of the charge chamber 122*c* changes and this change stops when the force resulting from the difference between the internal and external pressures of the charge chamber 122*c* and the reaction force from the side wall 122*a* of the bellows portion 122 come to equilibrium, just like the case where the air is sucked from the gas discharge passage by the suction pump 14. That is, the internal pressure of the charge chamber 122*c* and the inner volume of the charge chamber 122*c* are in the correlationship in this case, too.

The pressure detector 123 includes a movable portion 124, a plurality of slits 125, and a slit detecting sensor 126. The movable portion 124 is vertically movable with the ceiling wall 122*b* of the bellows portion 122. As seen in FIGS. 10A and 10B, the slits 125 are disposed at a right end of the movable portion 124 and arranged in a vertical direction, and each of the slits 262*a* extends in a lateral direction. The slit detecting sensor 126 detects each slit 125 vertically passing by the slit detecting sensor 126. Since the slits 125 vertically move with the ceiling wall 122*b* and the slit detecting sensor 126 detects passing of the slits 125 by the slit detecting sensor 126, the inner volume of the charge chamber 122*c* can be detected stepwise, that is, it is possible to detect or determine which of a predetermined plurality of values the inner volume currently takes.

As described above, the position of the ceiling wall 122*b*, or the inner volume of the charge chamber 122*c*, and the internal pressure of the charge chamber 122*c* are in a correlationship. On the other hand, the pressure detector 123 has the slit detecting sensor 126 that detects that the slits 125 disposed in the movable portion 124 vertically moving with the ceiling wall 122*b* pass by the slit detecting sensor 126. Hence, the pressure detector 123 can detect which of the predetermined values the internal pressure of the charge chamber 122*c* currently takes.

The detection of which of the predetermined values the inner volume of the charge chamber 122*c* currently takes enables, for instance, to freely change the degree in which the air is sucked from the air discharge passage by the suction pump 14 to make the inner pressure of the gas discharge passage negative, and to again suck the air from the gas discharge passage by the suction pump 14 when the internal pressure of the gas discharge passage has been increased to a level higher than a predetermined threshold by discharging the air from the ink passages 47*a*-47*d* to the individual air chambers 63*a*-63*d* while the internal pressure of the portion of the gas discharge passage between the valve device 9 and the air-permeable film 60 is held negative.

According to the embodiment, after the air is sucked by the suction pump 14 from the gas discharge passage, the internal pressure of the portion of the gas discharge passage between the valve device 9 and the air-permeable film 60 is held negative, as described above. However, over time, the air flows into the portion of the gas discharge passage where the internal pressure is held negative through a slight clearance between the valve element 104 and the air chamber 101 or others. In other words, the negative pressure leaks to the external. At this time, since the inks having been sucked from the inkjet head 3 via the ink suction cap 13 are present on or adhere to the switching device 15, the inks flow with the air from the switching device 15 to the valve device 9. Since the valve device 9 is constructed such that the valve element 104 is displaced rightward as seen in FIG. 9 by the suction pressure from the suction pump 14, which applies a relatively small force, so as to have the air chambers 101 and 102 communicated with each other, as described above, if the inks adhering to the switching device 15 separate therefrom and flow to and reach the air chambers 101, 102 and the communication passage 103 of the valve device 9, the inks adhere to the valve element 104 and the viscosity thereof increases there. This may make is impossible to displace the valve element 104 even when the suction pump 14 sucks the air from the gas discharge passage. If the valve element 104 cannot be displaced, it is impossible to have the air chambers 101 and 102 communicated with each other.

However, according to the embodiment where the first ink holding chamber 105 is disposed on the right side as seen in FIG. 9 of the air chamber 101 of the valve device 9 (that is, in the portion of the gas discharge passage between the differential pressure valve and the switching device 15), the inks flowing from the switching device 15 into the valve device 9 are trapped in the first ink holding chamber 105. Thus, it is prevented that the inks flow into the air chambers 101, 102 and the communication passage 103 and adhere to the valve element 104.

Since in the sub tank 4 the ink passages 47*a*-47*d* and the individual air chambers 63*a*-63*d* are separated from each other by the air-permeable film 60, normally the inks in the ink passages 47*a*-47*d* do not flow into the individual air chambers 63*a*-63*d* through the air-permeable film 60. However, after a long-term use, pores of the air-permeable film 60 are clogged with the inks in the ink passages 47*a*-47*d*, and ultimately the inks flow out of the ink passages 47*a*-47*d* into the individual air chambers 63*a*-63*d* through the air-permeable film 60. If the inks flow into the individual air chambers 63*a*-63*d*, when the suction pump 14 sucks the air from the gas discharge passage, the inks having flown into the individual air chambers 63*a*-63*d* are also sucked and flow from the individual air chambers 63*a*-63*d* to the valve device 9. If the inks flow into the air chambers 101, 102 and the communication passage 103 of the valve device 9 and adhere to the valve element 104, it may become impossible to have the air chambers 101 and 102 communicated with each other even when the suction pump 14 sucks the air from the tube 7*c*, just like the case described above.

However, according to the embodiment where the second ink holding chamber 106 is disposed on the left side as seen in FIG. 9 of the air chamber 102 of the valve device 9 (that is, in the portion of the gas discharge passage between the differential pressure valve and the air-permeable film 60), the inks having flown into the valve device 9 are trapped in the second ink holding chamber 106. Thus, it is prevented that the inks flow into the air chambers 101, 102 and the communication passage 103.

Further, since the first and second ink holding chambers 105, 106 are disposed at the vertical levels substantially same as the upper ends of the air chambers 101, 102, respectively, the inks trapped in the first and second ink holding chambers 105, 106 do not tend to flow out of the first and second ink holding chambers 105, 106 into the air chambers 101, 102 and the communication passage 103.

There will be described several modifications of the embodiment. Parts or elements identical with the corresponding parts or elements in the embodiment are denoted by the same reference numerals and description thereof is omitted.

Figure 11:
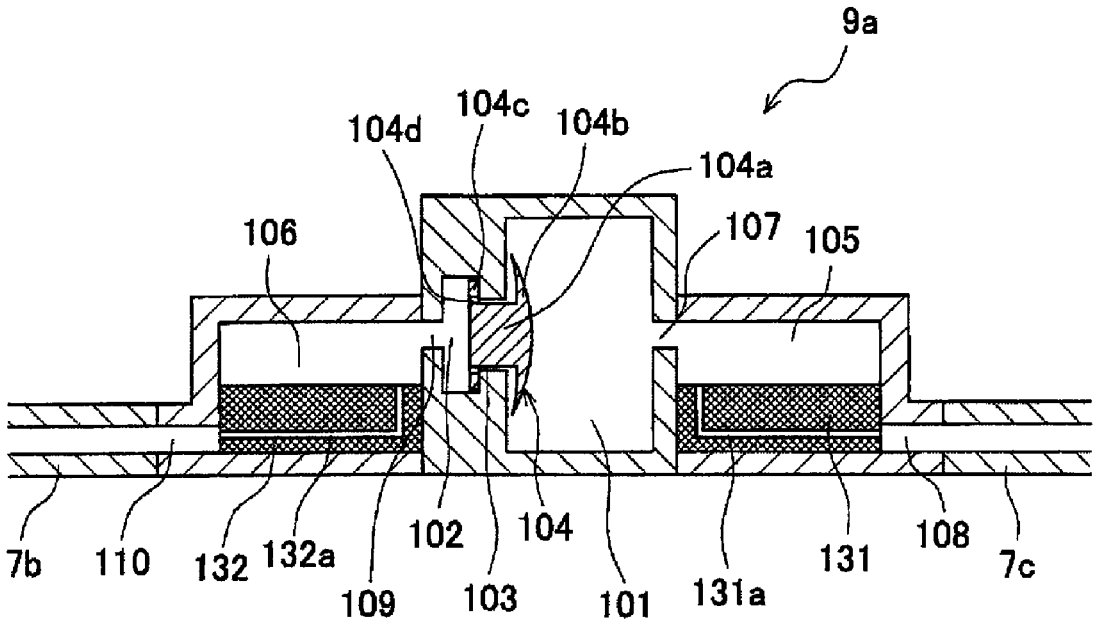
FIG. 11 is a cross-sectional view corresponding to FIG. 9, showing a first modification of the embodiment.

Referring to FIG. 11, there will be described a first modification of the embodiment where a differential-pressure valve device 9*a* is employed in place of the differential-pressure valve device 9. As shown in FIG. 11, the valve device 9*a* includes ink absorbing members 131, 132, each as a liquid retaining member, which are respectively disposed in the first and second ink holding chambers 105, 106 and formed of a material having a high ink absorbency such as spongy material. In the ink absorbing member 131, an air passage 131*a* is formed so as to communicate the communication port 108 with a space in the first ink holding chamber 105 and over the ink absorbing member 131. In the ink absorbing member 132, an air passage 132*a* is formed so as to communicate the communication port 110 with a space in the second ink holding chamber 103 and over the ink absorbing member 132.

In this modification, the inks having flown into the first and second ink holding chambers 105, 106 are respectively absorbed and retained by the ink absorbing members 131, 132, it is ensured that the inks are prevented from flowing out of the first and second ink holding chambers 105, 106 into the air chambers 101, 102 and the communication passage 103.

When the amount of the inks absorbed by the ink absorbing member 131, 132 is relatively large, the air permeability of the ink absorbing member 131, 132 lowers, and the ink absorbing member 131, 132 may inhibit the air flow when the suction pump 14 sucks the air from the gas discharge passage. According to the modification 1, however, the air passages 131*a*, 132*a* are formed in the ink absorbing members 131, 132, respectively, and hence the air can pass through the ink absorbing member 131, 132 by flowing in and along the air passage 131*a*, 132*a* even when the amount of the inks absorbed by the ink absorbing member 131, 132 is relatively large, thereby preventing the inhibition of the air flow.

Figure 12:
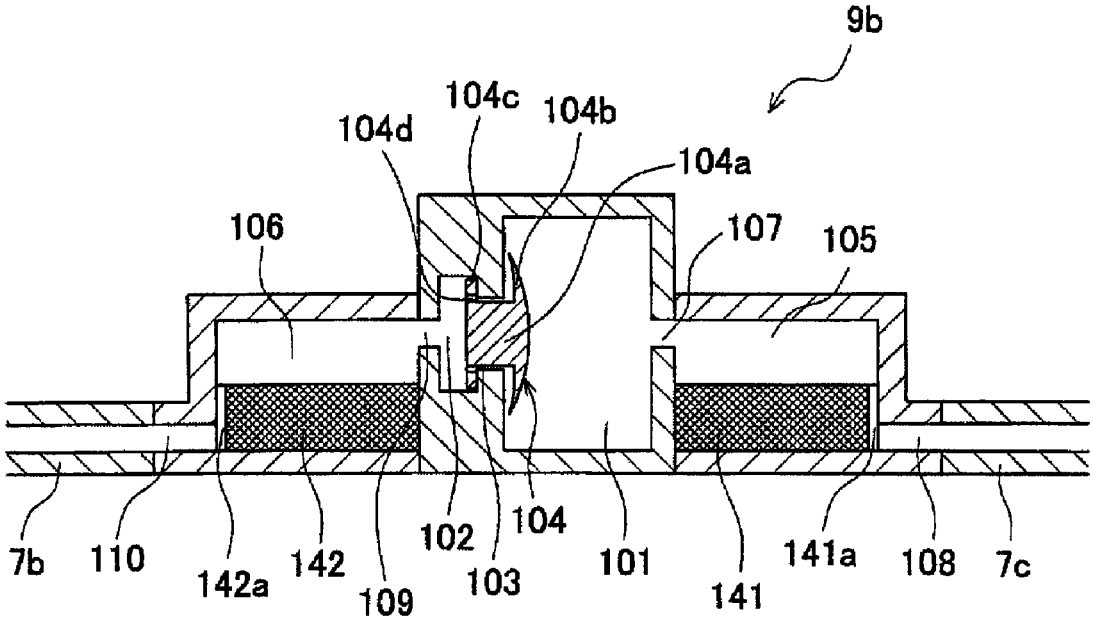
FIG. 12 is a cross-sectional view corresponding to FIG. 9, showing a second modification of the embodiment.

The air passages formed in the ink absorbing members are not limited to the air passages 131*a*, 132*a*. Referring to FIG. 12, there will be described a second modification of the embodiment where a differential-pressure valve device 9 in which the air passages are otherwise formed is employed in place of the differential-pressure valve device 9. As shown in FIG. 12, in the first and second ink holding chambers 105, 106 of the valve device 9*b*, ink absorbing members 141, 142 formed of the same material as the ink absorbing members 131, 132 are disposed. At an end of the ink absorbing member 141 on the side of the communication port 108, a groove 141*a* is formed as the air passage to vertically extend. At an end of the ink absorbing member 142 on the side of the communication port 109, a groove 142*a* as the air passage is formed to vertically extend. According to the second modification, even when the amount of the inks absorbed in the ink absorbing member 141, 142 is relatively large, the air can pass through the ink absorbing member 141, 142 by flowing in and along the groove 141*a*, 142*a*, thereby preventing the inhibition of the air flow.

Each of the air passages may take the form of a cutout or others in the ink absorbing members. In this case, too, even when the amount of the inks absorbed by the ink absorbing member is relatively large, the air can pass through the ink absorbing member by flowing in and along the air passage in the form of a cutout or others, thereby preventing the inhibition of the air flow by the ink absorbing member.

Figure 13:
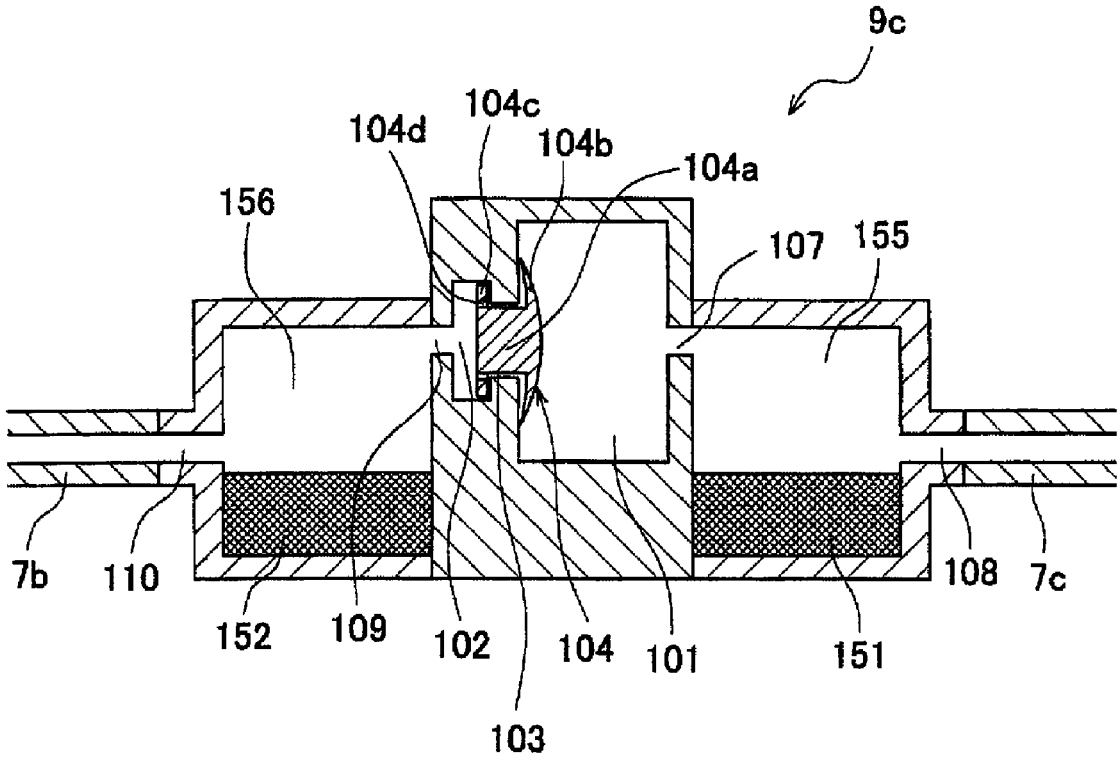
FIG. 13 is a cross-sectional view corresponding to FIG. 9, showing a third modification of the embodiment.

Referring to FIG. 13, there will be described a third modification of the embodiment where a differential-pressure valve device 9*c* is employed in place of the differential-pressure valve device 9. In the valve device 9*c* is formed a first ink holding chamber 155 in place of the first ink holding chamber 105. A part of the first ink holding chamber 155 is located below the communication port 108. In the part of the first ink holding chamber 155 located below the communication port 108, an ink absorbing member 151 formed of the same material as the ink absorbing member 131 is disposed. That is, two communication ports of the first ink holding chamber 155 respectively on the side of the differential pressure valve and on the side of the switching device 15 are both disposed above the ink absorbing member 151. A part of a second ink holding chamber 156 employed in place of the second ink holding chamber 106 is located below the communication port 110. In the part of the second ink holding chamber 156 located below the communication port 110, an ink absorbing member 152 formed of the same material as the ink absorbing member 132 is disposed.

According to this modification, the inks flowing into the ink holding chamber 155, 156 move downward by gravitation and are absorbed by the ink absorbing member 151, 152, while the air passes through a space in the first ink holding chamber 155, 156 over the ink absorbing member 151, 152. Hence, even when the amount of the inks absorbed by the ink absorbing member 151, 152 is relatively large, the ink absorbing member 151, 152 does not inhibit air flow across the ink holding chamber 155, 156.

Figure 14:
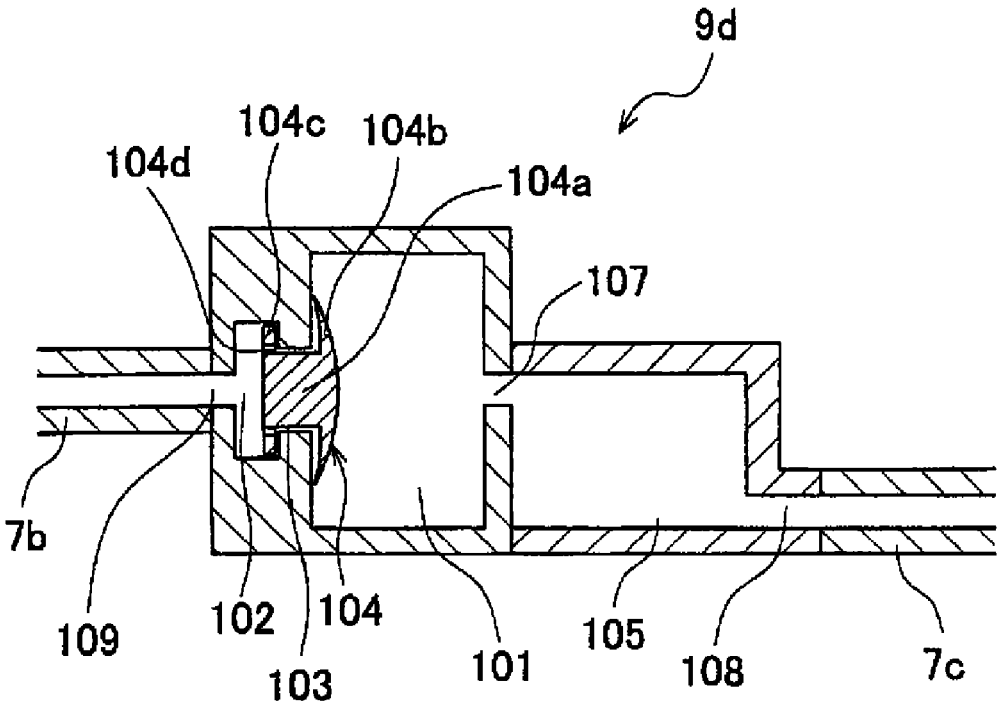
FIG. 14 is a cross-sectional view corresponding to FIG. 9, showing a fourth modification of the embodiment.

Referring to FIG. 14, there will be described a fourth modification of the embodiment where a differential-pressure valve device 9*d* is employed in place of the differential-pressure valve device 9. As shown in FIG. 14, the valve device 9*d* does not includes the second ink holding chamber 106 (shown in FIG. 9), and the tube 7*b* is directly connected with the communication port 109.

As described above with respect to the embodiment, as long as the internal pressure of the part of the gas discharge passage between the valve device 9 and the air-permeable film 60 is being held negative, there is a possibility that the inks in the switching device 15 flow to the valve device 9. On the other hand, the ink inflow from the sub tank 4 to the valve device 9 occurs only when the air-permeable film 60 (shown in FIG. 4) is deteriorated after a long-term use and the inks flow out of the ink passages 47*a*-47*d* (shown in FIG. 4) into the individual air chambers 63*a*-63*d* (shown in FIG. 4), and hence it does not tend to occur that the inks flow from the tube 7*b* to the valve device 9. Therefore, the valve device 9*d* includes the first ink holding chamber 105 but does not include the second ink holding chamber 106.

Figure 15:
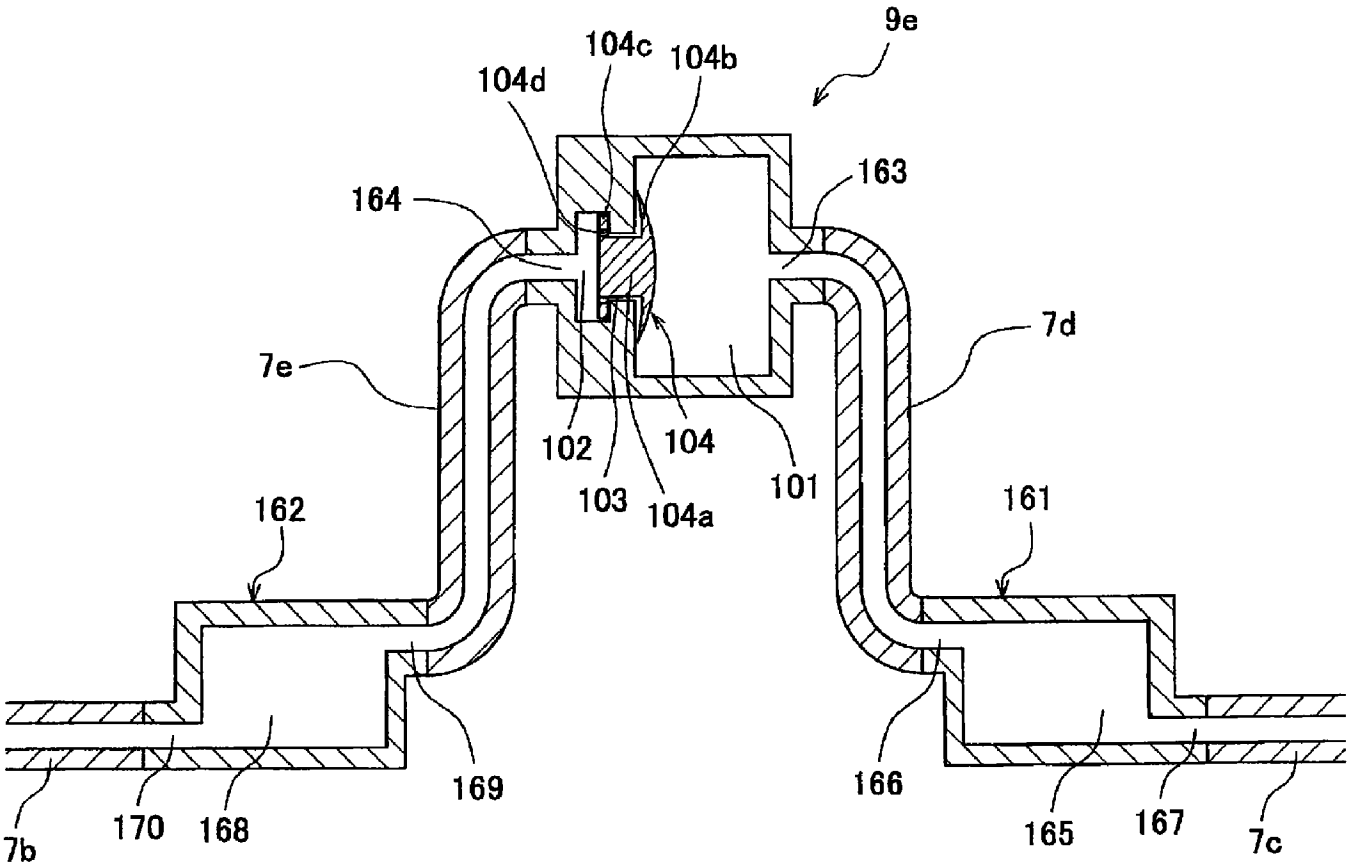
FIG. 15 is a cross-sectional view corresponding to FIG. 9, showing a fifth modification of the embodiment.

Referring to FIG. 15, there will be described a fifth modification in which the valve device does not includes the first and second ink holding chambers 105, 106 that are included in the above-described embodiment as shown in FIG. 9. More specifically, as shown in FIG. 15, a differential-pressure valve device 9*e* employed in the fifth modification in place of the differential-pressure valve device 9 does not include the first and second ink holding chambers 105, 106 shown in FIG. 9, but the printer 1 further includes liquid holders 161, 162 as members formed separately from the valve device 9*e*. The liquid holder 161 has a first ink holding chamber 165 similar to the first ink holding chamber 105. One 166 of two communication ports 166, 167 of the first ink holding chamber 165 is connected via a tube 7*d* with a communication port 163 communicated with the air chamber 101 of the valve device 9*e*. The other communication port 167 of the first ink holding chamber 165 is connected with the tube 7*c*. The liquid holder 162 has a second ink holding chamber 168 similar to the second ink holding chamber 106. One 169 of two communication ports 169, 170 of the second ink holding chamber 168 is connected via a tube 7*e* with a communication port 164 communicated with the air chamber 102 of the valve device 9*e*. The other communication port 170 of the second ink holding chamber 168 is connected with the tube 7*b*. The valve device 9*e* is disposed above the liquid holders 161, 162.

According to the fifth modification, the inks flowing from the tube 7*c* to the first ink holding chamber 165 are trapped in the first ink holding chamber 165 and do not tend to flow into the valve device 9*e*. On the other hand, the inks flowing from the tube 7*b* into the second ink holding chamber 168 are trapped in the second ink holding chamber 168 and do not tend to flow into the valve device 9*e*. Further, since the valve device 9*e* is disposed above the first and second ink holding chambers 165, 168, even when the inks flow into either of the tubes 7*d*, 7*e* beyond the first and second ink holding chambers 165, 168, the inks do not tend to reach the valve device 9*e*.

Figure 16:
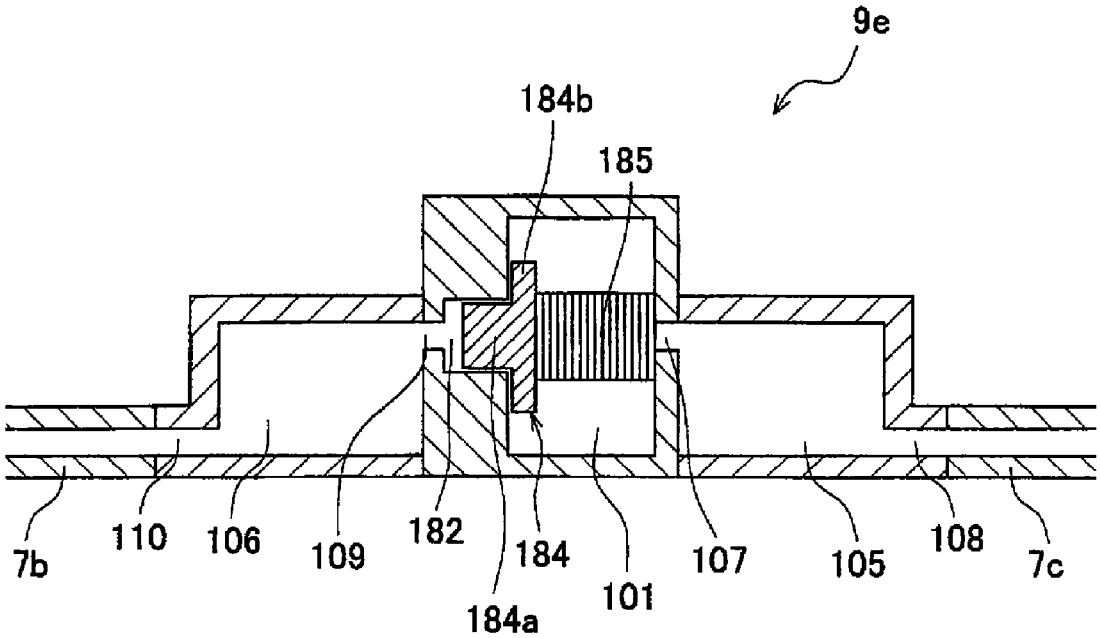
FIG. 16 is a cross-sectional view corresponding to FIG. 9, showing a sixth modification of the embodiment.

Referring to FIG. 16, there will be described a sixth modification of the embodiment. Unlike the embodiment, the sixth modification includes a pressure-difference valve device 9*f* that is not one including the air chambers 101, 102, the communication passage 103, and the valve element 104. More specifically, as shown in FIG. 16, the valve device 9*f* includes an air chamber 182 disposed on the left side of the air chamber 101 and extending in a left-right direction as seen in FIG. 16. As seen in the left-right direction of FIG. 16, the air chamber 182 has a substantially circular shape whose diameter is smaller than dimensions of the air chamber 101 in a vertical direction and a direction perpendicular to the plane of the sheet on which FIG. 16 is presented. The air chamber 182 is in communication with the communication port 109. In place of the valve element 104, the valve device 9*f* includes a valve element 184 including a columnar portion 184*a* and a cutoff portion 184*b*. The columnar portion 184*a* has a substantially cylindrical shape whose diameter is slightly smaller than that of the air chamber 182 extending in the left-right direction as seen in FIG. 16. The cutoff portion 184*b* is disposed at a right end as seen in FIG. 16 of the columnar portion 184*a*, and has a diameter larger than that of the columnar portion 184*a*. On a right surface of the cutoff portion 184*b* as seen in FIG. 16, a spring 185 is disposed to press the valve element 184 leftward as seen in FIG. 16.

According to the sixth modification of the embodiment, while the suction pump 14 does not operate to suck the air from the gas discharge passage, the valve element 184 is pressed leftward as seen in FIG. 16 by the spring 185 and a left surface of the cutoff portion 184*b* is in contact with a left wall surface of the air chamber 101, that is, communication between the air chamber 101 and the air chamber 182 is disconnected, and a portion of the gas discharge passage between the valve device 9*f* and the air-permeable film 60 (shown in FIG. 4) is airtight.

On the other hand, while the suction pump 14 operates to suck the air from the gas discharge passage, the valve element 184 is displaced rightward as seen in FIG. 16 by the suction pressure from the suction pump 14 against a pressing force from the spring 185. Thus, a clearance occurs between the left surface of the cutoff portion 184*b* and the left wall surface of the air chamber 101, whereby the air chamber 101 and the air chamber 182 are communicated with each other.

In the above-described embodiment, the communication ports 107, 109 are disposed at the substantially same vertical levels as the upper ends of the first and second ink holding chambers 105, 106, respectively. However, the communication port 107 may be disposed below the upper end of the first ink holding chamber 105, and the communication port 109 may be disposed below the upper end of the second ink holding chamber 106.

Although in the embodiment the air-permeable film 60 is disposed in the sub tank 4, this is not essential. As long as disposed in any point in the passage through which the inks are supplied from the ink cartridges 6*a*-6*d* to the inkjet head 3, the air-permeable film 60 may be disposed anywhere. There will be described with reference to FIGS. 17 and 18 a seventh modification of the embodiment as an example of the case where the air-permeable film 60 is not disposed in the sub tank 4. More specifically, in the seventh modification, the sub tank 4 does not include the air discharge device 23 and the air-permeable film 60 (shown in FIG. 3), and an air discharge device 190 is disposed in a portion of the ink tubes 51-5*d* connecting the ink cartridges 6*a*-6*d* with the sub tank 4, as shown in FIG. 17.

Figure 18:
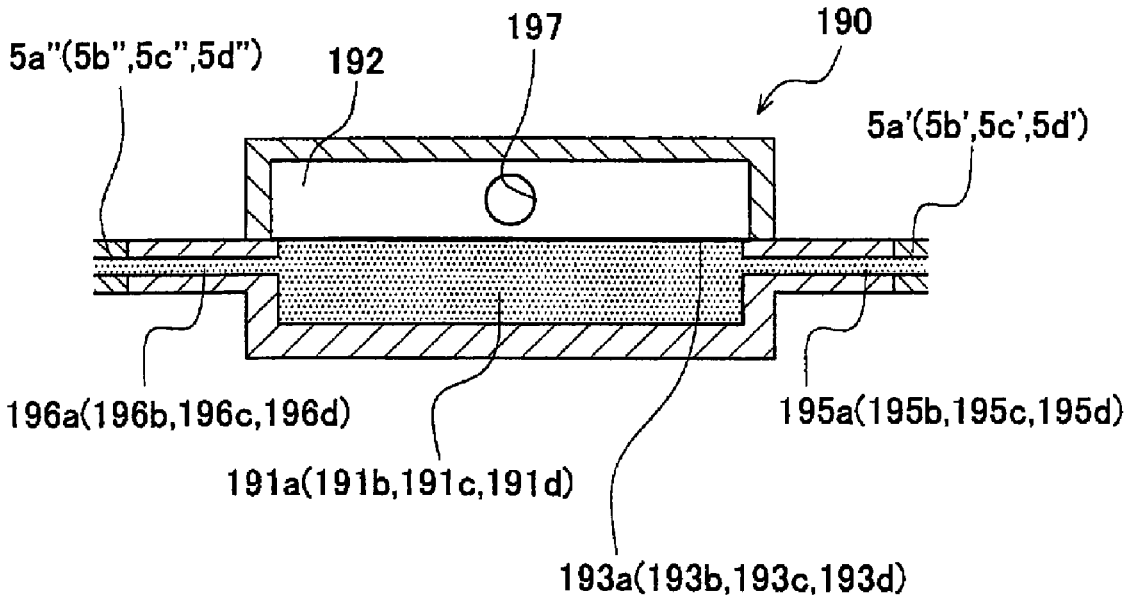
FIG. 18 is a cross-sectional view taken along lines 18-18 in FIG. 17.

FIG. 18 is a cross-sectional view taken along any one of four lines 18-18. Since cross-sectional views taken along these lines 18-18 are all identical, only one of the four views is representatively presented in FIG. 18, in which reference numerals related to a cross-sectional view taken along the leftmost one of the four lines 18-18 are presented without brackets, and reference numerals related to cross-sectional views taken along the other lines 18-18 are bracketed.

Figure 17:
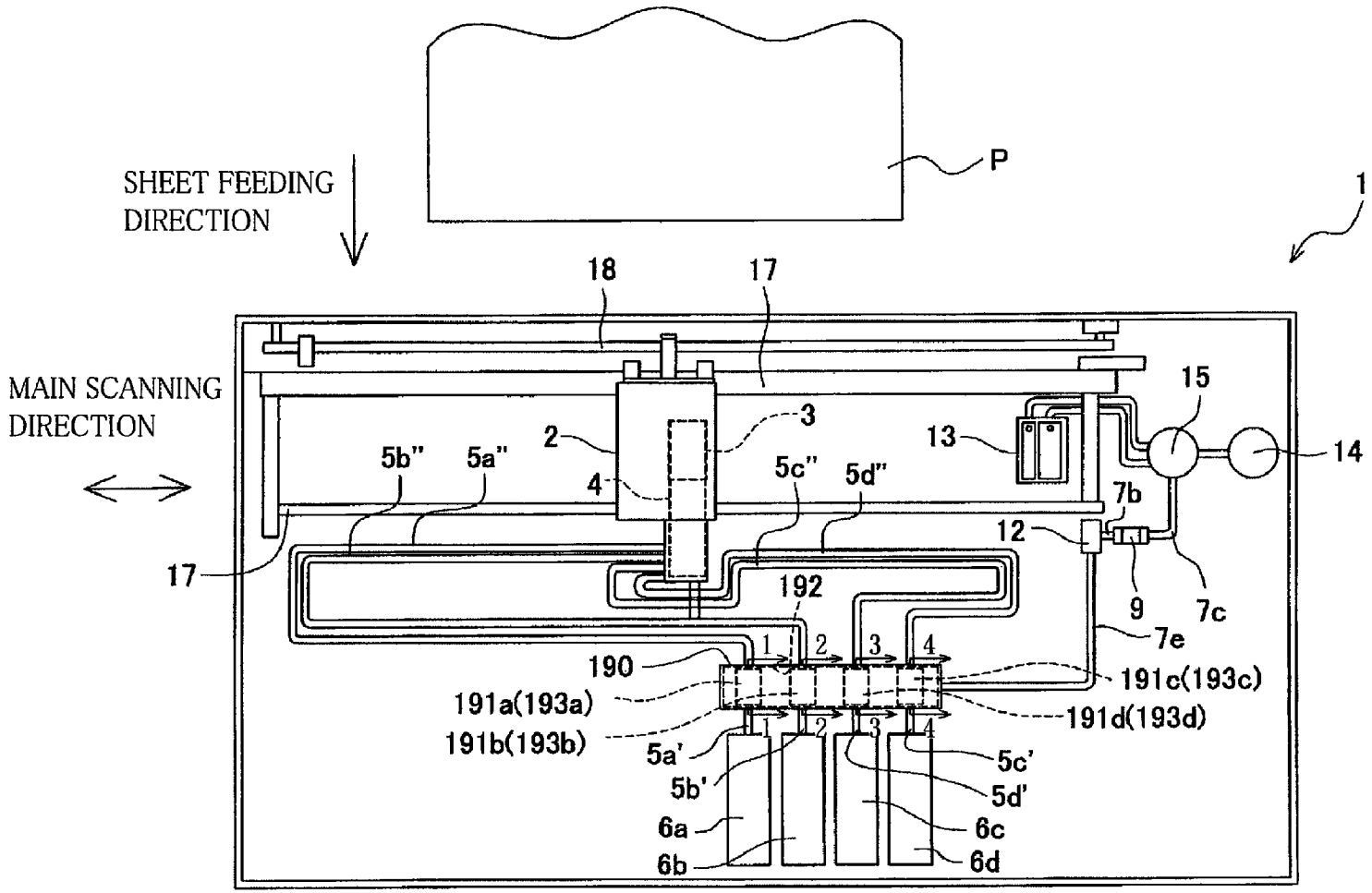
FIG. 17 is a cross-sectional view corresponding to FIG. 1, showing a seventh modification of the embodiment.

As shown in FIGS. 17 and 18, the air discharge device 190 includes ink chambers 191*a*-191*d*, an air chamber 192, and air-permeable films 193*a*-193*d*. The ink chambers 191*a*-191*d* have respective communication openings 195*a*-195*d* disposed at right ends thereof as seen in FIG. 18. At its communication opening 195*a*-195*d*, each of the ink chambers 191*a*-191*d* is connected with a corresponding one of the ink cartridges 6*a*-6*d* via an ink tube 5*a*'-5*d*'. The ink chambers 191*a*-191*d* further have respective communication openings 196*a*-196*d* disposed at left ends thereof as seen in FIG. 18. At its communication opening 196*a*-196*d*, each of the ink chambers 191*a*-191*d* is connected with a corresponding one of the inlet tubes 31*a*-31*d* (shown in FIG. 2) of the sub tank 4 via an ink tube 5*a*"-5*d*".

The air chamber 192 is disposed over the ink chambers 191*a*-191*d*, and extends across all the ink chambers 191*a*-191*d*. The air chamber 192 has a communication opening 197 at its right end as seen in FIG. 17, and is connected at the communication opening 197 with a tube 7*e*. Thus, via the tube 7*e*, the air chamber 192 and the charge tank 12 are connected with each other. The air-permeable films 193*a*-193*d* are disposed at positions overlapping the ink chambers 191*a*-191*d*, respectively, in plan view, and provide partition walls separating the ink chambers 191*a*-191*d* from the air chamber 192.

According to the seventh modification, in the air discharge device 190, the air in the ink chambers 191*a*-191*d* is discharged to the air chamber 192 through the air-permeable films 193*a*-193*d*. The air is then discharged from the air chamber 192 to the tube 7*e*. In the seventh modification, the air passage extending from the air chamber 192 to the switching device 15 via the tube 7*e*, the charge tank 12, the tube 7*b*, the valve device 9, and the tube 7*c* correspond to a gas discharge passage.

According to the seventh modification, the air-permeable films 193*a*-193*d* are disposed to correspond to the ink chambers 191*a*-191*d*. However, it may be arranged such that a single air-permeable film is disposed over the ink chambers 191*a*-191*d* to extend across all the ink chambers 191*a*-191*d*.

Alternatively, the embodiment may be modified such that in place of the single air-permeable film 60, discrete air-permeable films are disposed to correspond to the ink passages 47*a*-47*d*, as in the seventh modification.

Although there have been described one embodiment and its modifications where the invention is applied to a printer that ejects an ink droplet from a nozzle, the invention is applicable to a liquid ejecting apparatus that ejects a droplet of a liquid other than ink from a nozzle.

Although there has been described one embodiment of the invention and its modifications, it is to be understood that the invention is not limited to the details thereof, but may be otherwise embodied with various other modifications and improvements that may occur to those skilled in the art, without departing from the scope and spirit of the invention defined in the appended claims.

What is claimed is:

1. A liquid ejecting apparatus comprising:

a liquid ejecting head having a nozzle from which a liquid is ejected;

a liquid supply passage which is connected with the liquid ejecting head and supplies the liquid to the liquid ejecting head;

a gas discharge passage connected with the liquid supply passage so as to discharge a gas from the liquid supply passage;

a gas-permeable film which allows gases to pass therethrough but not allows liquids to pass therethrough and which provides a partition separating the gas discharge passage and the liquid supply passage from each other in a connecting portion where the gas discharge passage and the liquid supply passage are connected with each other;

a liquid suction cap for sucking the liquid in the liquid ejecting head through the nozzle;

a sucking device which sucks gases and liquids;

a switching device selectively connecting the sucking device with one of the gas discharge passage and the liquid suction cap;

a differential pressure valve disposed in a portion of the gas discharge passage between the gas permeable film and the switching device, the differential pressure valve (i) being opened by a suction pressure from the sucking device to communicate the gas permeable film and the switching device with each other while the sucking device is operating, and (ii) disconnecting communication between the gas permeable film and the switching device while the sucking device is not operating; and a first liquid holding chamber which is disposed in a portion of the gas discharge passage between the differential pressure valve and the switching device, and in which the liquid flowing into the gas discharge passage from the switching device is trapped.

2. The liquid ejecting apparatus according to claim 1, wherein a communication port of the first liquid holding chamber on a side of the differential pressure valve is disposed at a substantially same vertical level as an upper end of the first liquid holding chamber.

3. The liquid ejecting apparatus according to claim 2, wherein the differential pressure valve is disposed above the first liquid holding chamber.

4. The liquid ejecting apparatus according to claim 1, wherein the differential pressure valve is disposed above the first liquid holding chamber.

5. The liquid ejecting apparatus according to claim 1, wherein a liquid retaining member is disposed in the first liquid holding chamber so as to hold the liquid having flown into the first liquid holding chamber.

6. The liquid ejecting apparatus according to claim 5, wherein a first communication port of the first liquid holding chamber on a side of the differential pressure valve and a second communication port of the first liquid holding chamber on the side of the switching device are disposed above the liquid retaining member.

7. The liquid ejecting apparatus according to claim 5, wherein a gas passage is formed in the liquid retaining member to extend therethrough, the air passage allowing the gas to pass across the liquid retaining member from a first communication port of the first liquid holding chamber on the side of the differential pressure valve to a second communication port of the first liquid holding chamber on the side of the switching device without the liquid permeating the liquid retaining member.

8. The liquid ejecting apparatus according to claim 1, further comprising a second liquid holding chamber which is disposed in a portion of the gas discharge passage between the differential pressure valve and the gas permeable film, and in which the liquid is trapped when the liquid flows from the liquid supply passage through the gas permeable film into the gas discharge passage.

9. The liquid ejecting apparatus according to claim 1, wherein the liquid ejecting head ejects the liquid in a form of droplets.

10. The liquid ejecting apparatus according to claim 1, wherein the liquid ejecting head has a plurality of the nozzles and ejects an ink as the liquid to perform a recording on a recording medium opposed to the liquid ejecting head.

* * * * *